US007309557B2

(12) United States Patent
Yoshizawa et al.

(10) Patent No.: US 7,309,557 B2
(45) **Date of Patent: *Dec. 18, 2007**

(54) IMAGE FORMING APPARATUS AND IMAGE FORMING METHOD

(75) Inventors: Hideo Yoshizawa, Fuchu (JP); Tomoe Kitani, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 460 days.

This patent is subject to a terminal disclaimer.

(21) Appl. No.: 10/912,884

(22) Filed: Aug. 6, 2004

(65) Prior Publication Data

US 2006/0029878 A1 Feb. 9, 2006

(51) Int. Cl.
*G03G 13/20* (2006.01)

(52) U.S. Cl. ..... 430/124.1; 430/58.8; 430/108.1

(58) Field of Classification Search ..... 430/124, 430/58.8, 108.1, 124.1
See application file for complete search history.

(56) References Cited

U.S. PATENT DOCUMENTS

| | | | | |
|---|---|---|---|---|
| 6,653,035 | B2 * | 11/2003 | Komoto et al. | 430/106.1 |
| 2003/0219666 | A1 * | 11/2003 | Kitani et al. | 430/108.1 |

FOREIGN PATENT DOCUMENTS

| | | |
|---|---|---|
| JP | 07104514 | 4/1995 |
| JP | 07181693 | 7/1995 |
| JP | 07333867 | 12/1995 |
| JP | 08015962 | 1/1996 |
| JP | 08240966 | 9/1996 |
| JP | 08311191 | 11/1996 |
| JP | 10254165 | 9/1998 |
| JP | 11184130 | 7/1999 |
| JP | 11249334 | 9/1999 |
| JP | 2001034016 | 2/2001 |
| JP | 2001166508 | 6/2001 |
| JP | 2002030192 | 1/2002 |
| JP | 2002055486 | 2/2002 |
| JP | 2002082472 | 3/2002 |

OTHER PUBLICATIONS

Japanese Article ISBN 4-7693-4128-8 C3058 Cover page and pp. 188 through 197.

* cited by examiner

*Primary Examiner*—Mark A. Chapman
(74) *Attorney, Agent, or Firm*—Lucas & Merchant, LLP

(57) ABSTRACT

An image forming apparatus comprising an electrophotographic photoreceptor to form a toner image by developing an electrostatic latent image with a developer containing a toner and a developing device, in which the photoreceptor contains a charge transport compound having a triphenylamine structure and the developing device supplies a toner having a total content of aromatic volatile compounds of 5 to 30 ppm; an image forming method employing the foregoing electrophotographic photoreceptor and developing device.

11 Claims, 3 Drawing Sheets

IMAGE FORMING APPARATUS AND IMAGE FORMING METHOD

BACKGROUND

1. Technical Field

The present invention relates to an image forming apparatus and an image forming method.

2. Related Art

To obtain high quality images over a long duration even when printed at high speed in a large amount, it is necessary to use an electrophotographic photoreceptor exhibiting superior electric potential characteristics especially when repeatedly used at high speed and a toner which is fixable at low temperature and still resulting in high quality images, and in addition, it is also essential that the developer containing a electrophotographic photoreceptor and a toner does not deteriorate even after being allowed to stand in an image forming apparatus over an extended period of time.

Commercially available, electrophotographic image forming apparatuses comprise a charger, an image exposure device, a developing device and a transfer device, and an optional cleaning device.

A corona charger is the most popular as a charger generally used, which has the advantage that charging can be stably conducted at high speed. However, application of high voltage to the corona charger produces a large amount of ionized oxygen, ozone, moisture, nitrogen oxide compounds and the like. Such products give rise to problems such as deterioration of an electrophotographic photoreceptor (hereinafter, also denoted simply as a photoreceptor) or adversely affecting the human body.

Recently, there has been studied a contact charging system instead of employing a corona charger. Specifically, a voltage is applied to a charging member such as a charging roller, a charging blade, a charging brush or a magnetic brush, which is brought into contact with a photoreceptor to charge the photoreceptor surface at a prescribed electric potential. The use of such a contact charging system results in reduced voltage, as compared to a noncontact charging system employing a corona charger, thereby leading to reduced generation of ozone. However, there is a further problem in the contact charging system in that a charging roller or the like directly is in contact with a photoreceptor and often abrades the photoreceptor surface or its continuous contact causes peeling-off or cracking of the photosensitive layer of the photoreceptor, easily giving rise to image defects. Specifically, such problems easily occur under severe conditions such high temperature and high humidity (for example, an environment of 30° C. and 80% RH).

Further, in image formation employing color copiers or color printers, an image forming apparatus in which the respective single color images are formed on plural photoreceptors and transferred to a transfer material to form color images, has been noted from the viewpoint of prints being obtained at high speed.

In particular, a photoreceptor containing a charge transporting compound having a triphenylamine structure exhibits superior high-speed responsibility and other satisfactory characteristics.

However, when high-volume printing was conducted under high-temperature and high-humidity, using the foregoing photoreceptor containing a charge transporting compound having a triphenylamine structure in combination with a polymerization toner which has recently been noted as a toner resulting in high quality images, there were produced problems such that image defects occurred. In an attempt to confirm circumstances, it was revealed that a number of cracks were produced in the photosensitive layer of a photoreceptor and specifically when allowed to stand in a stand-by state over a long period of time (e.g., one week) after a large-volume printing run, occurrence of cracking was marked in the photoreceptor at portions in contact with integral members such as a charger, a transfer device and a cleaning blade.

As a result of studying the causes thereof, it was proved that among volatile ingredients contained in a toner, a large amount of volatile aromatic compounds adversely affected the photoreceptor. Specifically, it was found that the volatile aromatic compounds vaporized in the thermal fixing stage and adhered to the photosensitive layer, causing cracks forming image defects at portions in close contact with the charger, a transfer device, a cleaning blade or the like, or the volatile aromatic compounds bled out of the toner, staining the photosensitive layer and causing the cracking.

It was contemplated that occurrence of cracking was marked specifically when the photosensitive layer contained a charge transporting compound having a structure exhibiting affinity to volatile aromatic compounds contained in the toner.

It was also assumed that, specifically in current printers, copiers and color printers, air-exhaustion was suppressed along with miniaturization and gases which vaporized from a toner at the time of thermal fixing, easily accumulated inside the device, and thereby problems became more and more obvious.

A group of toners, called a polymerization toner whereby high quality imaged can be easily obtained, is characterized in that the tone formation of from monomer polymerization to toner particle formation is undergone without allowing resin to stand in a dried state. Accordingly, used raw materials (e.g., solvent, monomer), impurities contained in the raw materials and reaction by-products are easily included in the toner. As a result, such raw materials, impurities contained in the raw materials and reaction by-products are easily filled in an image forming apparatus during storage over a long period of time or at the time of thermal fixing.

When the load applied by a member contacting a photoreceptor is small, excessive stress is not applied to the photoreceptor and cracking rarely occurs. On the contrary, excessively applying the load of a charging roller or a cleaning blade to maintain charging conditions or cleaning conditions results in markedly increased occurrence.

The portion exhibiting cracks causes a gradual increase in potential of the exposure area, readily causing partial fogging.

In the present status, when a high-sensitive photoreceptor using a charge transporting compound, having a triphenylamine structure and a toner exhibiting superior low temperature fixability and achieving high quality image formation are loaded into an image forming apparatus in which a photoreceptor is directly in contact with a charger, a transfer device or a cleaning blade and subjected to printing at a high-volume (e.g., 10,000 sheets) under high-temperature and high-humidity (e.g., 30° C., 80% RH), and thereafter, allowed to stand under high-temperature and high-humidity over a long period of time (e.g., one week), the photosensitive layer of the photoreceptor deteriorates (for example, an increase in potential in exposed areas and occurrence of cracking), forming image defects, whereby superior, high-quality images cannot be obtained over a long period of time.

SUMMARY

In one aspect the invention is directed to an image forming apparatus comprising an electrophotographic photoreceptor to form a toner image by developing an electrostatic latent image with a developer containing a toner and a developing device, wherein the photoreceptor contains a charge transport compound having a triphenylamine structure and the developing device supplies a toner having a total content of aromatic volatile compounds of 5 to 30 ppm. In another aspect the invention is directed to an image forming method employing the foregoing electrophotographic photoreceptor and developing device.

DETAILED DESCRIPTION OF EXEMPLARY EXAMPLES

Figure 1:
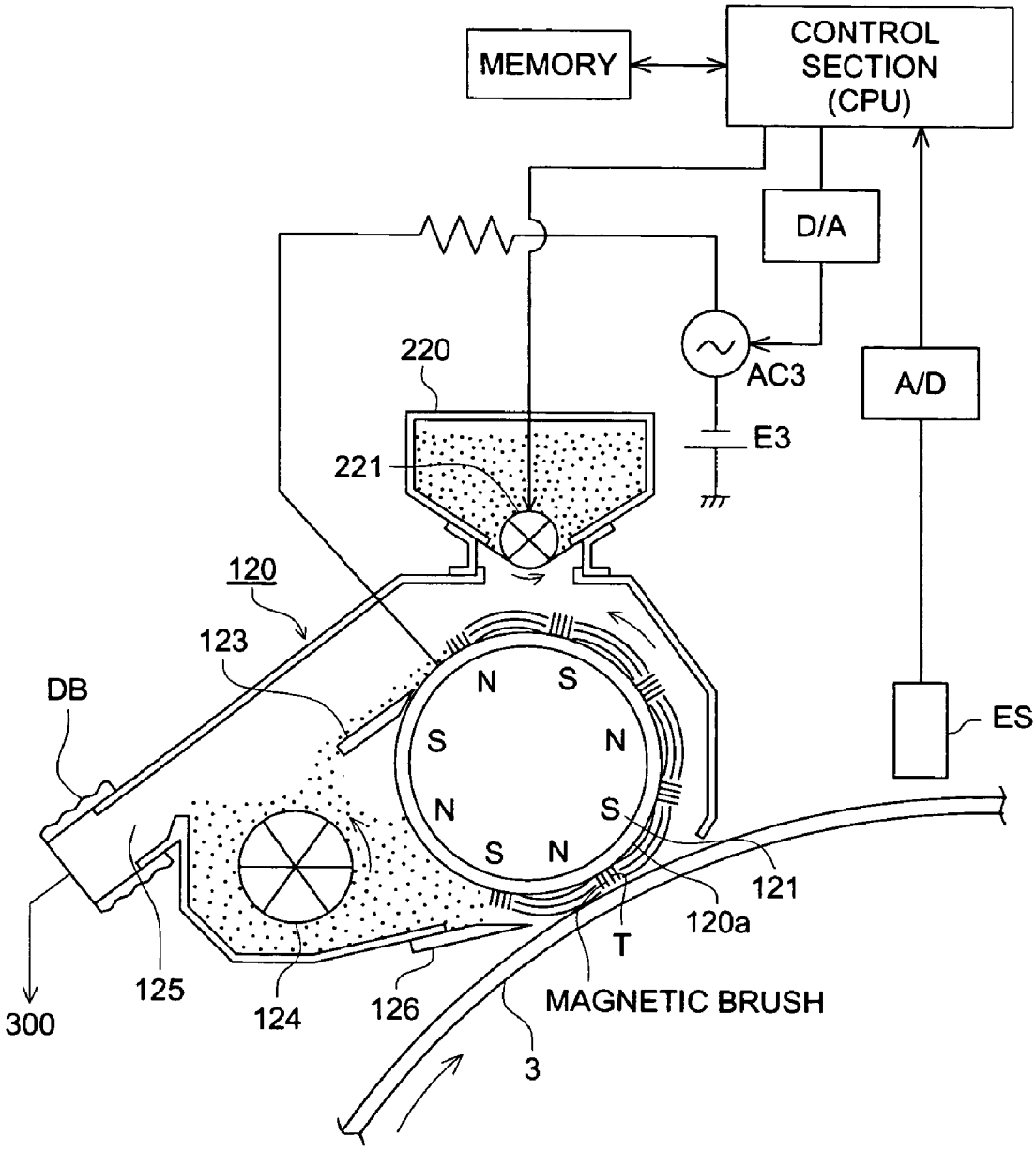
FIG. 1 is a schematic diagram illustrating a contact type magnetic brush.

There will hereinafter be described details based on examples.

One feature of the photoreceptor is that it contains a compound having a triphenylamine structure as a charge transporting compound.

The compound having a triphenylamine structure is represented by the following formula (1):

formula (1)

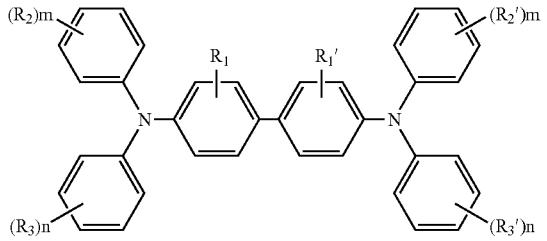

wherein $R_1$ and $R_1'$ which may be the same or different, are each a halogen atom, a substituted or unsubstituted alkyl group, or a substituted or unsubstituted alkoxy group; $R_2$, $R_2'$, $R_3$ and $R_3'$ which may be the same or different, are each a halogen atom, a substituted or unsubstituted alkyl group, a substituted or unsubstituted allyl group, a substituted or unsubstituted alkenyl group, a substituted or unsubstituted alkoxy group or a substituted amino group; m and n, which may be the same or different, are each 0, 1 or 2.

Specific examples of the compound having a triphenylamine structure are shown below but are by no means limited to these.

(1-1)

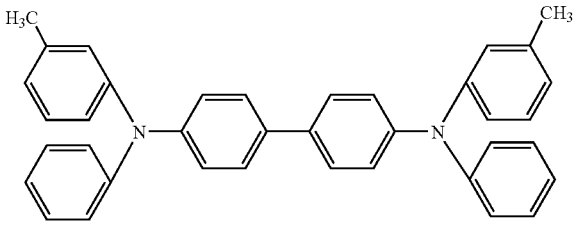

(1-2)

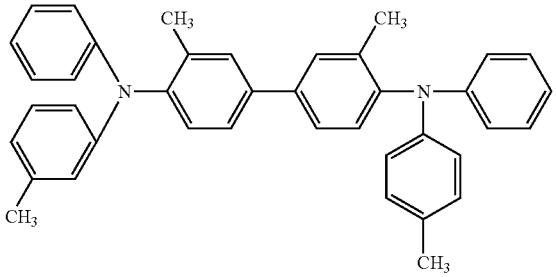

(1-3)

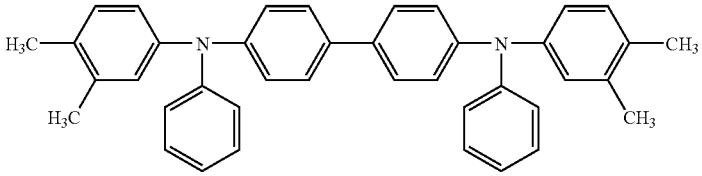

-continued (1-4)

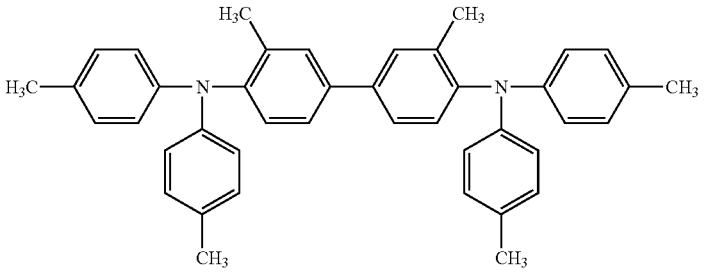

(1-5)

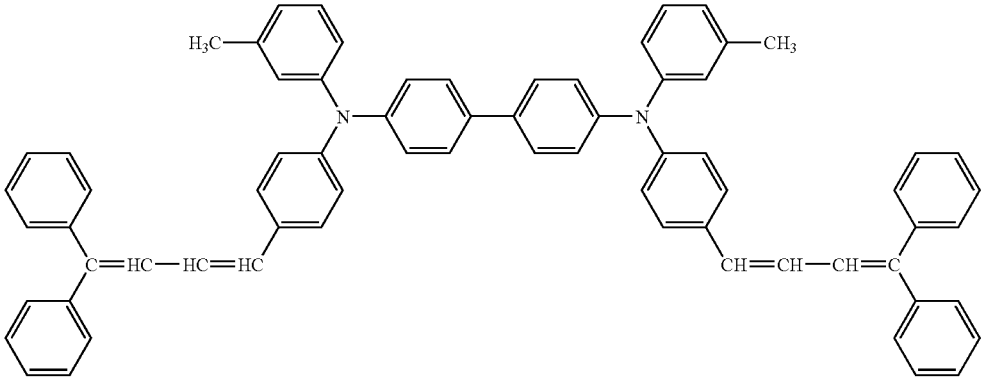

(1-6)

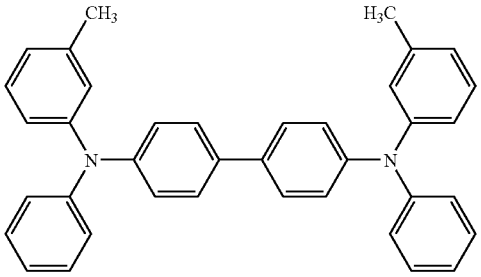

The charge transporting compound having a triphenylamine structure is usable in negative charge separated-function type photoreceptors, monolayer photoreceptors and photoreceptors having an inverted layer structure but is not limited to a specific kind of a photoreceptor.

The toner contains a volatile aromatic compound in an amount of 5 to 30 ppm by weight, based on the toner, which can be determined in the head space method.

The volatile aromatic compound detectable in the head space method refers to a compound having a group or structure unit exhibiting aromaticity within the molecule, among compounds having peaks which can be detected in head space gas chromatography. The content can be calculated by summing up the whole of volatile aromatic compounds exhibiting a peak area of 0.2 ppm or more, based on the ratio of a peak area vs. the concentration of toluene.

Examples of volatile aromatic compounds include ethylbenzene, n-propylbenzene, isopropylbenzene, n-butylbenzene, n-pentylbenzene, n-hexylbenzene, methylstyrene, toluene and xylene. These volatile aromatic compounds are assigned to that raw materials used in toner polymerization, impurities contained in raw materials and by-products resulted in the toner polymerization are include in the toner. The total content of the volatile aromatic compounds is preferably 5 to 30 ppm, and more preferably 8 to 25 ppm. Contents falling within the foregoing range result in enhanced productivity such as shortening the manufacturing time of the toner or simplifying the manufacturing process and reduces the amount of aromatic compounds vaporized from the toner at the time when allowed to stand in an image forming apparatus or subjected to thermal fixing, leading to lessened deterioration of the photosensitive layer.

Methods for determining the content of volatile aromatic compound(s) are not specifically limited and the determination thereof can be achieved by appropriately choosing commonly known chemical analysis means, as exemplified below.

The volatile aromatic compound can be quantitatively determined by a head space system gas chromatography using a detecting method employed in conventional gas chromatography, such as an internal standard method. In this method, a toner is sealed in a vessel and heated to a temperature near the setting temperature of the fixing device provided in the image forming apparatus using the toner, and when the vessel is filled with volatile components, gas contained in the vessel is injected into a gas chromatograph to perform mass spectrometry (MS) as well as determination of the volatile component content.

The measurement using head space gas chromatography is detailed as below.

1. Sampling:

A sample of 0.8 g is collected into a 20 ml vial for use in head space, wherein the sampling amount is weighed to the order of 0.01 g (which is necessary to calculate the area per unit weight). The vial is sealed with a septum using a special crimper.

2. Sample Heating

The sample is put vertically into a incubator maintained at 170° C. and heated for 30 min.

3. Setting of Gas Chromatographic Separation Condition:

There is used a separation column of 3 mm inside diameter and 3 m length, which is filled with a carrier coated with silicone oil SE-30 in a weight ratio of 15%. The column is loaded onto a gas chromatograph and helium gas is allowed to flow at a rate of 50 ml/min. The column temperature is set to 40° C. and the measurement was done, while raising the temperature to 260° C. at a rate of 15° C./min. After reaching 260° C., the column is maintained for 5 min.

4. Introduction of Sample:

The vial is taken out of the incubator and 1 ml gas generated from the sample is collected using a gas-tight syringe and injected into the column.

5. Calculation:

Of compounds detected between n-hexane and n-heptadecane under the condition described below, the total area of compound peaks exhibiting at least 5% of the peak area of 30 ppm styrene is converted to a concentration, based on the ratio of concentration to peak area of toluene to determine the concentration of the whole aromatic hydrocarbon compound.

6. Equipment and Material (1) Head Space Condition:

Head Space Device:

HP7694 "Head Space Sample", available from Hewlett-Packard Corp.

Temperature Condition:

Transfer line: 200° C.

Loop temperature: 200° C.

Sampling amount: 0.8 g/20 ml vial (2) GC/MS Condition:

GC: HP5890, available from Hewlett-Packard Corp.

MS: HP5971, available from Hewlett-Packard Corp.

Column: HP-624 30 m×0.25 mm

Oven temperature: 40° C. (3 min)-15° C./min-260° C.

Measurement mode: SIM

Constitution of the photoreceptor and preparation thereof are described below.

The photoreceptor preferably comprises an electrically conductive support provided thereon with an interlayer and a photosensitive layer, and further thereon, a protective layer may also be provided.

(1) Conductive Support

A cylindrical conductive support is used as a conductive substrate for the photoreceptor. The cylindrical conductive support means a cylindrical support capable of endless image formation by rotation. A conductive support exhibiting a straightness of 0.1 mm or more and a torsion of 0.1 mm or less is preferred. A support not falling within the foregoing ranges regarding the straightness and torsion makes it difficult to form superior images.

Examples of a conductive material include a metal drum such as aluminum or nickel, a plastic drum on which aluminum, tin oxide, indium oxide or the like is deposited, and a paper•plastic drum. A conductive support exhibiting a specific resistance of not more than $10^3$ Ωcm is preferred. Further, the photoreceptor may be in the form of an endless belt.

(2) Interlayer:

An interlayer is provided between the conductive support and the photosensitive layer to improve adhesion between the conductive support and the photosensitive layer and also to prevent charge injection from the conductive support. Examples of materials used for the interlayer include a polyamide resin, a vinyl chloride resin, a vinyl acetate resin and a copolymer resin containing at least two of repeating units of the foregoing resins. Of these resins, a polyamide is preferred to reduce the increase of residual potential after repeated use. The thickness of the interlayer using the foregoing resin preferably is 0.01 to 2.0 μm.

A more preferred interlayer is one using a hardened metal resin which is thermally hardened with a silane coupling agent or a titanium coupling agent. The interlayer using a hardened metal resin preferably has a thickness of 0.01 to 2.0 μm. Another preferred interlayer is one which contains a titanium oxide dispersed in a binder resin. The thickness of such an interlayer containing a titanium oxide is preferably 0.1 to 15 μm.

(3) Photosensitive Layer:

The photosensitive layer of a photoreceptor may have a single layer structure comprising one interlayer having a charge generation function and a charge transport function, but preferably has a layer structure in which the function of the photosensitive layer is separated to a charge generation layer and a charge transport layer. Such a function-separated layer structure lessens an increase of residual potential along with the repeated use and can easily control other electrophotographic characteristics. A photoreceptor for use in negative-charging preferably has a layer arrangement which comprises on an interlayer a charge generation layer and further thereon a charge transport layer. In a photoreceptor for use in positive-charging, the layer arrangement of the foregoing photoreceptor for use in negative-charging is reversed. Of these, the more preferred photosensitive layer arrangement is that of the photoreceptor for use in negative-charging, which has the function-separated layer structure, as described above.

The photosensitive layer arrangement of a separated-function type negative-charging photoreceptor will be described below.

Charge Generation Layer:

A charge generation layer comprises a charge generation material and a binder resin, which is formed by coating charge generation material dispersed in the binder.

Commonly known phthalocyanine compounds are usable as a charge generation material. A titanyl phthalocyanine compound and a hydroxygallium phthalocyanine compound are preferred. Further, a titanyl phthalocyanine compound, such as titanyl phthalocyanine Y-type or A-type (β-type) is preferred, which is characterized having a main peak of a Bragg angle for Cu-Kα characteristic X-ray. Oxytitanyl phthalocyanine compounds are described in JP-A No. 10-69107. The foregoing charge generation materials may be used singly or in combination of at least two of them (for example, a mixture of Y-type and A-type), or may be used in a mixture form with a polycyclic quinone compound, such as a perylene pigment.

Commonly known resins are usable as a binder resin of the charge generation layer and examples thereof include polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing at least two of the foregoing resins (for example, vinyl chloride-vinyl acetate copolymer resin), and polyvinyl carbazole resin, but are not limited to the foregoing resins.

A charge generation layer is preferably prepared in a manner that using a dispersing machine, a charge generation material is dispersed in a solution of a binder resin dissolved in a solvent to prepare a coating solution and then, the coating solution is coated at a given thickness and dried to form the charge generation layer. Solvents used for dissolution and coating of a binder resin to form the charge generation layer include, for example, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, 1,3-dioxorane, pyridine, and diethylamine, but are not limited to these.

An ultrasonic homogenizer, a ball mill, a sand grinder and a homomixer are usable as a means for dispersing charge generation material but are not limited to these. Examples of a coater to form a charge generation layer include a dipping coater and ring coater, but are not limited to these. The ratio of charge generation material to binder resin is preferably 1-600 parts (more preferably 50-500 parts) by weight of charge generation material to 100 parts by weight of binder resin. The charge generation layer thickness, depending on characteristics of charge generation material and binder, preferably is 0.01 to 5 μm.

Charge Transport Layer:

A charge transport layer comprises a charge transport compound and a binder resin, which is formed by coating a charge transport compound dispersed in the binder.

The charge transport compound is one having a triphenylamine structure represented by the foregoing formula (1), which may be used in combinations thereof. There may be included a charge transport compound other than the one represented by the formula (1).

Commonly known resins are usable as a binder resin for use in a charge transport layer and examples thereof include polycarbonate resin, polyacrylate resin, polyester resin, polystyrene resin, styrene-acrylonitrile copolymer resin, polymethacrylic acid ester resin and styrene-methacrylic acid ester copolymer resin. Of these, polycarbonate resin is preferred, and BPA, BPZ and dimethyl-BPA of polycarbonate and a BPA-dimethyl-BPA copolymer are more preferred in terms of abrasion resistance and electrostatic-charging characteristics.

The charge transport layer is preferably prepared in such a manner that a binder resin and a charge transport compound are dissolved to form a coating solution, which is coated at a given layer thickness and dried to form the charge transport layer. Examples of a solvent used for dissolution of a binder resin and a charge transport compound include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, 1,3-dioxorane, pyridine, and diethylamine, but are not limited to these. The ratio of a charge transport compound to a binder resin is preferably 10-500 parts (more preferably 20-100 parts) by weight of charge generation compound to 100 parts by weight of binder resin. The charge transport layer thickness, depending on characteristics of charge transport material, binder resin and mixing ratio, preferably is 10 to 100 μm, and more preferably 15 to 40 μm.

An antioxydizing agent (AO reagent), an electron-accepting material (EA reagent) or a stabilizer may be incorporated into the charge transport layer. Specifically, AO reagents described in Japanese Patent Application No. 11-200135 and EA reagents described in JP-A Nos. 50-137543 and 58-76483 are preferred.

(4) Protective Layer:

To enhance durability, a protective layer may be provided on the charge transport layer. A protective layer using siloxane resin exhibits improved durability and is preferred, as described in JP-A Nos. 9-190004, 10-095787 and 2000-171990.

As described above, the preferred layer arrangements of the photoreceptor are exemplified and a layer arrangement other than the foregoing is also acceptable.

The constitution of a toner and preparation thereof are exemplarily described below.

A preparation method of a toner preferably is polymerization of a polymerizable monomer in an aqueous medium, in which a polymerizable monomer is polymerized by the process of suspension polymerization to prepare resin particles or the monomer is polymerized in liquid (aqueous medium) containing an emulsifying agent by the process of emulsion polymerization to form resin particles, and after optionally adding charge-controlling resin particles, an organic solvent and a flocculant such as salts are added thereto to cause the resin particles to flocculate and fuse.

(1) Suspension Polymerization

A preparation method of a toner is described as below. A charge controlling resin is dissolved in a polymerizable monomer and various constituent materials such as a colorant, a polymerization initiator and an optional mold-releasing agent are added thereto and allowed to dissolve or be dispersed in the monomer using a homogenizer, a sand mill, a sand grinder or a ultrasonic homogenizer. Using a homomixer or a homogenizer, the monomer, together with the dissolved or dispersed constituent materials, is dispersed in an aqueous medium containing a dispersion stabilizer to form oil droplets exhibiting a size desired as a toner. Thereafter, the thus formed dispersion is transferred to a reaction apparatus (stirring apparatus) having a stirring mechanism provided with a stirring blade as described later and heated to undergo polymerization. After completion of the reaction, the dispersion stabilizer is removed and the reaction mixture is subjected to filtration, washing and drying to prepare a toner. Herein, the aqueous medium refers to one containing at least 50% by weight of water.

(2) Emulsion Polymerization

Preferred as another example of a toner preparation is a method in which resin particles are subjected to flocculation and fusion in an aqueous medium to prepare a particulate toner. This method is not specifically limited and includes methods described in JP-A Nos. 5-265252, 6-329947 and 9-15904. Thus, it is a method in which resin particles and dispersed particles of a constituent material such as a colorant, or plural particulate constituents such as resin and a colorant are subjected to salting-out, flocculation and fusion; specifically, after dispersing these using an emulsifying agent, a flocculant is added thereto at a concentration of more than the critical flocculation concentration to cause salting-out and simultaneously, heated at a temperature more than the glass transition temperature of the formed polymer to cause particles to fuse to gradually grow the particles, and when reaching the intended particle size, a large amount of water is added to stop the particle growth and heating and stirring are further continued to smoothen the particle surface and to control the particle size, thereafter, the particles which are in the water-bearing and floating state, are dried with heating to form the toner desired. An infinitely water-soluble solvent, such as alcohol, may be added concurrently with a flocculent.

There is preferably employed a method of preparing toners in which, after dissolving a crystalline material in a polymerizable monomer, the monomer is polymerized to form composite resin particles and the thus formed resin particles and color particles are subjected to flocculation and fusion. The crystalline material may be dissolved or melted in the monomer.

A process in which composite resin particles obtained in a multistep polymerization process and color particles are subjected to flocculation and fusion is preferred n the preparation of toners. A multistep polymerization is described below.

Composite Resin Particle Obtained in Multistep Polymerization

The multistep polymerization process preferably comprises the following steps:

1: multistep polymerization step,

2: flocculation/fusion step in which composite resin particles and color particles are allowed to flocculate and to fuse to obtain toner particles, 3: filtration and washing step in which the toner particles are filtered out of the toner particle dispersion and washed to remove surfactant and the like, 4: drying step in which the washed toner is dried, and 5: a step of adding an external additive to the dried toner particles.

The foregoing steps are further described below.

Multistep Polymerization Step:

The multistep polymerization step is a polymerization process which is undergone to expand the molecular weight distribution of resin particles to obtain toner particles preventing off-setting. Thus, polymerization reaction is undergone in the manner of being separated to multiple steps (or stepwise) to form phases differing in molecular weight distribution in the interior of the resin particle so that the obtained resin particles each exhibit a molecular weight gradient from the center of the particle to the surface. For example, after a dispersion of high molecular weight resin particles is obtained, a polymerizable monomer and a chain transfer agent are further added thereto to the low molecular weight surface layer.

Multistep polymerization of three steps or more is preferred in terms of manufacturing stability and fracturing resistance. There will be described the two-step polymerization process and three-step polymerization process, as representative examples of multi-step polymerization. In the toner obtained in the multistep polymerization reaction, the outer layer is preferably comprised of a low molecular weight resin in terms of fracturing resistance.

Two-Step Polymerization:

The two-step polymerization process is a process of preparing composite resin particles which are each comprised of a central portion (nucleus) formed of a high molecular weight resin, containing a crystalline material, and an outer layer (shell) formed of a low molecular weight resin. Specifically, a monomer solution obtained by dissolving a crystalline material in a monomer is dispersed in an aqueous medium (e.g., aqueous surfactant solution) in the form of oil drops and this system is subjected to polymerization (1st polymerization step) to prepare a dispersion of resin particles (H) of high molecular weight, containing a crystalline material. Subsequently, to the dispersion of resin particles, a polymerization initiator and a monomer to obtain a low molecular weight resin are added and allowed to be polymerized (2nd polymerization step) in the presence of the resin particles to form a covering layer comprised of a low molecular weight resin on the resin particle surface.

Three-Step Polymerization:

The three-step polymerization process is a process of preparing composite resin particles which are comprised of a central portion (nucleus) formed of a high molecular weight resin, an interlayer containing a crystalline material and an outer layer (shell) formed of a low molecular weight resin. Thus the composite resin particles prepared by the three-step polymerization process are composed of a nucleus, and two covering layers. Specifically, a dispersion of resin particles obtained according to a conventional polymerization process (1st polymerization step) is added to an aqueous medium (e.g., aqueous surfactant solution), a monomer solution obtained by dissolving a crystalline material in a monomer is dispersed in the aqueous medium in the form of oil drops and this system is subjected to polymerization (2nd polymerization step) to prepare a dispersion of composite resin particles (high molecular weight resin-intermediate molecular weight resin) having a covering layer (interlayer) comprised of resin (polymer of the monomer) on the surface of the resin particle (nucleus particle). Subsequently, to the obtained composite resin particle dispersion, a polymerization initiator and a monomer to obtain a low molecular weight resin are added and allowed to be polymerized (3rd polymerization step) in the presence of the resin particles to form a covering layer comprised of a low molecular weight resin (polymer of monomer) on the resin particle surface. Introduction of the interlayer can disperse the minute crystalline material homogeneously.

In one embodiment of the toner preparation method, a polymerizable monomer is polymerized in an aqueous medium. Resin particles (nuclei) containing a crystalline material or a covering layer (interlayer) can be formed in such a manner that the crystalline material is dissolved in a monomer and the obtained monomer solution is dispersed in the form of oil droplets dispersed in an aqueous medium, then, this system is further subjected to polymerization process to obtain latex particles. Herein, the aqueous medium refers to a medium comprised of 50 to 100 wt % water and of a 0 to 50 wt % water-soluble organic solvent. Examples of a water-soluble organic solvent include methanol, ethanol, isopropanol, butanol, acetone, methyl ethyl ketone, and tetrahydrofuran and alcohol type organic solvents not dissolving the obtained resin are preferred.

Examples of a polymerization process suitable for the foregoing formation of resin particles containing a crystalline material or a covering layer include a process in which a surfactant is dissolved in an aqueous medium at a concentration less than the critical micelle concentration and a monomer solution obtained by dissolving a mold-releasing agent is dispersed in the form of oil droplets dispersed in the aqueous medium, employing mechanical energy, then, a water-soluble polymerization initiator is added to the obtained dispersion to allow radical polymerization to occur within the oil droplets (hereinafter, also called a mini-emulsion method). Further, instead of adding a water-soluble polymerization initiator, an oil-soluble polymerization initiator may be added to the monomer solution, concurrently with the addition of the water-soluble polymerization initiator.

In the mini-emulsion method differing from the conventional emulsion polymerization method, a crystalline material dissolved in an oil phase does not leave the oil phase and a sufficient amount of the mold-releasing agent can be introduced into the formed resin particles containing a crystalline material or a covering layer. Dispersing machines to perform the foregoing oil droplet dispersion employing mechanical energy are not specifically limited, including, for example, a stirring apparatus provided with a high-speed rotor, CLEAR MIX (product of M Technique Co., Ltd.), an ultrasonic disperser, a mechanical type homogenizer, Manton-Gaulin homogenizer and a pressure type homogenizer. The dispersing particle size is 10 to 1000 nm, preferably 50 to 1000 nm, and more preferably 30 to 300 nm. The phase separation structure of a crystalline material of the toner, that is, a Feret horizontal diameter, shape factor and their coefficients of variation may be controlled to control the dispersing particle size distribution.

Commonly known methods such as the emulsion polymerization method, the suspension polymerization method and the seed polymerization method are also adoptable as a polymerization process for forming resin particles containing a crystalline material or a covering layer. These polymerization methods are also adaptable to obtain resin particles (nucleus) or a covering layer constituting composite resin particles and contain no crystalline material.

The sizes of composite resin particles obtained in the foregoing polymerization process, which can be determined using a electrophoresis light-scattering photometer (ELS-800, product of Otsuka Denshi Co., Ltd.), are within the range of 10 to 1000 nm.

The glass transition temperature (Tg) of composite resin particles is preferably within the range of 48 to 74° C., and more preferably 52 to 64° c., and the softening point of the composite resin particles is preferably within the range of 95 to 140° C.

The toner is obtained by allowing resin particles to be fused onto the resin and color particle surface through flocculation and fusion to form a resin layer. This will be further described below.

Flocculation/Fusion Step:

The flocculation/fusion step is a stage in which composite resin particles obtained in the foregoing multistep polymerization step and color particles are allowed to be flocculated and fused to form irregular-form (or non-spherical) toner particles (in which flocculation and fusion simultaneously occur). The flocculation/fusion means flocculation (flocculation of particles) and fusion (disappearance of the interface between particles) being concurrently caused, or action allowing flocculation and fusion to be concurrently caused. To allow flocculation and fusion to concurrently result, it is preferred to flocculate particles (composite resin particles, color particles) at a temperature higher than a glass transition temperature (Tg) of a resin forming the composite resin particles.

In the flocculation/fusion step, particles of an internal additive such as a charge control agent (microparticles having a number-average primary particle size of 10 to 1000 nm) may be flocculated and fused together with composite resin particles and color particles. Color particles may be surface-modified, in which commonly known surface-modifiers are usable.

Ripening Step:

The ripening step is a step following the foregoing flocculation/fusion step, in which a crystalline material is phase-separated, while the temperature is maintained near the melting point of a crystalline material, and preferably within a melting point+20° C. The phele horizontal diameter, shape factor and their coefficients of variation can be controlled in this step.

The sum of divalent (or trivalent) metal elements added as a flocculant and monovalent metal elements added as a flocculation terminator is preferably 350 to 35000 ppm. The residual content of metal ions in a toner can be determined using fluorescent X-ray spectrometer System3270 Type (available from Rigaku Denki Corp.), in which the intensity of fluorescent X-rays emitted from metal species of metal salts used as a flocculant (e.g., calcium originating in calcium chloride) is measured. Specifically, plural toners having a known metal salt flocculent content are prepared and 5 g of each of the toners is pelletized, then, the relationship (calibration curve) between the metal salt flocculant content (ppm by weight) and intensities of fluorescent X-rays emitted from metal species of the metal salts are determined. Subsequently, a toner (sample) to determine the metal salt flocculant content is similarly pelletized and the intensity of a fluorescent X-ray emitted from a metal specie of the metal salt flocculant is measured to determine the content, that is, the residual quantity of metal ions contained in the toner.

Filtration and Washing Step:

The filtration and washing step comprises filtration to filter off toner particles from the toner particle dispersion, obtained in the foregoing step, and washing to remove adherents such as surfactants or coagulants from the filtrated toner particles (aggregates in a cake form). Filtration methods are not specifically limited, including centrifugal separation, reduced-pressure filtration using a Nutsche funnel and a filtration method using a filter press.

The drying step is a stage of drying the washed toner particles in which the content of the whole volatile aromatic compound contained in the toner. Drying machines usable in this step include, for example, a spray drier, a vacuum freeze drier and a reduced-pressure drier; and a standing rack drier, a moving rack drier, a fluidized-bed drier, a rotary drier and a stirring drier, which are pressure-reducible, are preferably used. Dried toner particles preferably have a moisture content of not more than 5% and more preferably not more than 2% by weight. When dried particles are aggregated with each other by attraction force between particles, the aggregates may be disintegrated. Mechanical disintegrating apparatuses such as a jet-mill, a Henschel mixer, a coffee mill or a food processor can be employed as a disintegrating apparatus.

It is preferred to prepare the toner in the manner that composite resin particles are formed in the absence of a colorant and a dispersion of color particles is added to a dispersion of the composite resin particles to cause the composite particles and the color particles to be salted out, flocculated and fused. Inhibition of the polymerization reaction to obtain the composite resin can be avoided by preparation of the composite resin particles in the absence of a colorant. As a result, staining of the fixing apparatus and image staining, which are caused by accumulation of a toner, can be reduced without vitiating superior off-set resistance. The polymerization reaction to obtain composite resin particles is completely undergone so that no monomer or no oligomer remains in toner particles and, during the imaging process, production of foul odors is reduced in the thermal fixing stage using the toner. Further, surface characteristics of the thus obtained toner particles are uniform, leading to a narrow distribution of electrostatic charge, whereby formation of images exhibiting superior sharpness can be achieved over a long period of time. Using such a toner which is homogeneous in composition, molecular weight and surface characteristic among particles, enhancement of off-set resistance and prevention of winding can be achieved in the imaging process including a fixing step of a contact heating system, leading to formation of images exhibiting an optimal glossiness.

Hereinafter, constituent factors used in the process of preparing toners will be described.

Polymerizable Monomer

A polymerizable toner to make a resin (binder) of the toner comprises a hydrophobic monomer as an essential component and a cross-likable monomer is optionally used therein. It is desirable to contain at least a monomer having a acidic polar group or a monomer having a basic polar group.

(1) Hydrophobic Monomer:

Hydrophobic monomers constituting monomer components are not specifically limited and commonly known hydrophobic monomers are usable. One or more monomers can be used in combination to meet required characteristics.

Specifically, there are usable a monovinylaromatic type monomer, a (metha)acrylic acid ester type monomer, a vinyl ester type monomer, a vinyl ether type monomer, a monoolefin type monomer, a diolefin type monomer and a halogenated olefin type monomer. Examples of a vinyl aromatic type monomer include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and their derivatives. Examples of acryl type monomers include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate. Examples of a vinyl ester type monomer include vinyl acetate, vinyl propionate, and vinyl benzoate. Examples of a vinyl ether type monomer include vinyl methyl ether, vinyl ethyl ether, vinyl sobutyl ether and vinyl phenyl ether. Example of a monoolefin type monomer include ethylene, propylene, isobutylene, 1-butene, 1-pentene and 4-methyl-1-pentene. Example of diolefin type monomer include butadiene, isoprene and chloroprene.

(2) Cross-linkable Monomer:

A cross-linkable monomer may be added to improve characteristics of resin particles. Examples of a cross-likable monomer include ones containing at least two unsaturated bonds, such as divinylbenzene, divinylnaphthalene, divinylether, diethylene glycol methacrylate, ethylene glycol dimethacrylate, polyethylene glycol dimethacrylate and diacryl phthalate.

(3) Acidic Polar Group-containing Monomer:

Monomers containing an acidic polar group include (a) a α,β-ethylenically unsaturated compound containing a carboxyl group (—COOH), and (b) a α,β-ethylenically unsaturated compound containing a sulfonic acid group (—$SO_3H$). Examples of (a) a α,β-ethylenically unsaturated compound containing a carboxyl group (—COOH) include acrylic acid, methacrylic acid, fumaric acid, methacrylic acid, itaconic acid, cinnamic acid, monobutyl maleate, monooctyl maleate and their metal salts, such as Na or Zn. Examples of (b) a α,β-ethylenically unsaturated compound containing a sulfonic acid group (—$SO_3H$) include a sulfonated styrene and its Na salt, allylsulfosuccinic acid, octyl allylsulfosuccinate and their Na salt.

(4) Basic Polar Group-containing Monomer:

Examples of monomers containing a basic polar group include (i) a (metha)acrylic acid ester of an aliphatic alcohol containing an amine or a quaternary ammonium group and 1 to 21 carbon atoms (preferably 2 to 8, and more preferably 2 carbon atoms); (ii) a (metha)acrylic acid amide or a (metha)acrylic acid amide which is substituted by mono- or di-alkyl group of 1 to 18 carbon atoms on a N-atom; (iii) a vinyl compound which is substituted by a N-containing heterocyclic group; and (iv) a N,N-diallyl-alkylamine or its quaternary ammonium salt. Of these, a (metha)acrylic acid ester of an aliphatic alcohol containing an amine or a quaternary ammonium group is preferred as a basic polar group-containing monomer.

Examples of (i) a (metha)acrylic acid ester of an aliphatic alcohol containing an amine or a quaternary ammonium group include dimethylaminoethyl acrylate, dimethylaminoethyl methacrylate, diethylaminoethyl acrylate, diethylaminoethyl methacrylate, quaternary ammonium salts of the foregoing four compounds, 3-dimethylaminophenyl acrylate, and 2-hydroxy-3-methacryloxypropyl methylammonium. Examples of (ii) a (metha)acrylic acid amide or a (metha)acrylic acid amide which is substituted by mono- or di-alkyl group on a N-atom include acrylamide, N-butyl acrylamide, N,N-dibutylacrylamide, piperidyl acrylamide, methacrylamide, N,N-dimethyl acrylamide and N-octadecyl acrylamide. Examples of (iii) a vinyl compound which is substituted by a N-containing heterocyclic group include Examples of (iii) a vinyl compound which is substituted by a N-containing heterocyclic group include vinylpyridine, vinylpyrrolidone, vinyl-N-methylpyridinium chloride and vonyl-N-ethypyridinium chloride. Examples of (iv) a N,N-diallyl-alkylamine or its quaternary ammonium salt include N,N-diallylmethlammonium chloride and N-N-diallylethylammonium chloride.

Polymerization Initiator:

(also simply called initiators). Any water-soluble polymerization initiator (also simply called initiators) is optimally usable. Examples thereof include persulfates (e.g., potassium persulfate, ammonium persulfate), azo compounds [e.g., 4,4'-azobis-cyanovaleric acid and its salt, 2,2'-azobis(2-amidinopropane)-salt], and peroxide compounds such as hydrogen peroxide and benzoyl peroxide. The foregoing polymerization initiators may be combined with a reducing agent and used as a redox initiator. The use of a redox initiator results in enhanced polymerization activity and lowering of the polymerization temperature, thereby shortening the polymerization time. The polymerization temperature can be chosen at any temperature higher than the lowest temperature forming a radical of an initiator, for example, within the range of 50 to 80° C. The use of polymerization initiators initiating at ordinary temperature, for example, a combination of hydrogen peroxide and a reducing agent (e.g., ascorbic acid) enables polymerization at room temperature or a temperature close thereto.

Surfactant:

To undergo mini-emulsion polymerization using a polymerizable monomer described above, it is preferred to disperse the monomer in the form of oil droplets dispersed in an aqueous medium, using a surfactant. Surfactant usable therein are not specifically limited but preferred surfactants include ionic surfactants.

Example of an ionic surfactant include sulfonic acid salts (e.g., sodium dodecybenzenesulfonate, sodium arylalkyl polyether sulfonate, sodium 3,3-disulfonediphenylurea-4,4-diazo-bis-8-sodium-6-sulfonate, o-carboxybenzene-azo-dimethylaniline, sodium 2,2,5,5-tetramethyl-triphenylmethane-4,4-diazo-bis-β-naphthol-6-sulfonate), a sulfuric acid eater salts (e.g., sodium dodecylsulfate, sodium tetradecylsulfate, sodium pentadecylsulfate, sodium octylsulfate) and carboxylic acid salts (e.g., sodium oleate, sodium laurate, sodium caprylate, sodium caproate, potassium stearate, calcium oleate).

There are also usable nonionic surfactants. Specific examples thereof include polyethylene oxide, polypropylene oxide, a combination of polyethylene oxide and polypropylene oxide, an ester of polyethylene glycol and a higher fatty acid, alkylphenol polyethylene oxide, an ester of a higher fatty acid and polyethylene glycol, an ester of a higher fatty acid and polypropylene oxide and sorbitan ester.

The foregoing surfactants are mainly used as an emulsifying agent in emulsion polymerization but may be used in other processes or for other purposes.

Flocculant:

Flocculants are chosen from metal salts. Metal salts used as a flocculant or a flocculation terminator, as described hereinafter, include mono-valent metal salts, for example, salts of alkali metals such as sodium, potassium and lithium; di-valent metal salts, for example, salts of alkaline earth metals such as calcium and magnesium and di-valent metal salts such as manganese and copper; and tri-valent metal salts, such as iron and aluminum. Specific examples thereof include mono-valent metal salts such as sodium chloride, potassium chloride and lithium chloride; di-valent metal salts such as magnesium chloride, calcium chloride, calcium nitrate, zinc chloride, copper sulfate, magnesium sulfate and manganese sulfate; tri-valent metal salts such as aluminum chloride and iron chloride. These are optimally chosen according to the object.

The foregoing critical flocculation concentration is a measure relating to stability of dispersed material in an aqueous dispersion, indicating a concentration at which flocculation occurs when adding a flocculent. The critical flocculation concentration varies depending on the flocculant itself and the dispersing agent used therein, which are described, for example, in S. Okamura et al., "Kobunshi Kagaku" 17, 601 (1960) and therefrom, values can be found. Alternatively, a desired salt is added to a particle dispersing solution with varying the concentration to measure the ζ-electric potential of the particle dispersing solution and the salt concentration at which the ζ-electric potential starts to vary can be defined as the critical flocculation concentration.

A particulate polymer dispersion is treated using the metal salt described above so as to form a concentration greater than the critical flocculation concentration. In this regard, directly adding a metal salt or addition in the form of an aqueous solution is appropriately chosen according to the object. When added in the form of an aqueous solution, the concentration of the added metal salt needs to be greater that the critical flocculation concentration, based on the whole volume of the particulate polymer dispersion and the aqueous metal salt solution. The concentration of a metal salt used as a flocculant may be greater than the critical flocculation concentration, preferably by a factor of at least 1.2 and more preferably at least 1.5 times greater than the critical flocculation concentration.

Colorant:

The toner can be obtained by subjecting the foregoing composite resin particles and color particles to flocculation/fusion.

Colorants (color particles which are subjected, together with composite resin particles, to flocculation/fusion) constituting the toner include various inorganic pigment, organic pigments and dyes. Commonly known inorganic pigments are usable and specific examples of inorganic pigments are as follows.

Black pigments include, for example, carbon black such as furnace black, channel black, acetylene black, thermal black and lamp black and magnetic powders such as magnetite and ferrite. These inorganic pigments can be used singly or in combinations according to intention. The pigment is added in an amount of 2 to 20% and preferably 3 to 15% by weight. In cases where it is used as a magnetic toner, the foregoing magnetite may be incorporated. To provide given magnetic characteristics, magnetite is contained preferably in an amount of 20 to 120% by weight, based on toner.

There are also usable commonly known organic pigments and dyes. Specific examples of organic pigments are as follows.

Magenta and red pigments include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow pigments include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Green or cyan pigments include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Further, usable dyes include, for example, C.I. Solvent Red 1, the said 49, the said 52, the said 58, the said 63, the said 111, the said 122; C.I. Solvent Yellow 19, the said 44, the said 77, the said 79, the said 81, the said 82, the said 93, the said 98, the said 103, the said 104, the said 112, the said 162; and C.I. Solvent Blue 25, the said 36, the said 60, the said 70, the said 93 and the said 95. A mixture of the foregoing dyes is also usable.

The foregoing organic pigments and dyes are usable alone or in combinations of a plurality of them. The pigments are usually incorporated in an amount of 2 to 20%, and preferably 3 to 15% by weight, based on polymer.

The colorant (color particles) constituting the electrostatic image developing tone may be subjected to a surface-modifying treatment. Commonly known surface modifiers are usable and specifically, a silane coupling agents, a titanium coupling agent, or an aluminum coupling agent are preferably used. Silane coupling agents include an alkoxysilane such as methylmethoxysilane, phenyltrimethoxysilane, methylphenyldimethoxysilane and diphenyldimethoxysilane, a siloxane such as hexamethyldisiloxane, γ-chloropropyl-trimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyl-trimethoxysilane, γ-aminopropyltriethoxysilane, and γ-ureidopropyltriethoxysilane. Titanium coupling agents include, for example, TTS, 9S, 38S, 41B, 46B, 55, 138S and 238S which are commercially available, as a trade name "Plain Act", from Ajinomoto Co., Inc.; A-1, B-1, TOT, TST, TAA, TAT, TLA, TOG, TBSTA, A-10, TBT, B-2, B-4, B-7, B-10, TBST, A-400, TTS, TOA-30, TSDMA, TTAB and TTOB which are commercially available from Nippon Soda Co., Ltd. Aluminum coupling agents include, for example, "Plain Act AL-M" (product of Ajinomoto Co., Inc.).

The surface modifier is incorporated preferably in an amount of 0.01% to 20%, and more preferably 0.1% to 5% by weight, based on colorant. Surface modification methods of color particles include, for example, incorporating a surface modifier to a color particle dispersion and heating to cause a reaction. Surface-modified color particles are filtered off, and after washing with an identical solvent and filtering are repeated, the particles are dried.

Mold-releasing Agent:

A toner preferably is one which is obtained by allowing resin particles occluding a mold-releasing agent to be fused in an aqueous medium. Subjecting such resin particles occluding a mold-releasing agent and color particle to flocculation/fusion results in a toner in which the mold-releasing agent is finely dispersed.

As a mold-releasing agent, a low molecular weight polypropylene (having a number-average molecular weight of 1500 to 9000) or a low molecular weight polyethylene os preferred, and a specifically preferred mold-releasing agent is a compound represented by the following formula:

$$R_1\text{—}(OCO\text{—}R_2)_n$$

wherein n is an integer of 1 to 4 (preferably 2 to 4, more preferably 3 or 4 and still more preferably 4); $R_1$ and $R_2$ are each a hydrocarbon group, which may be substituted. $R_1$ has 1 to 40 carbon atoms (preferably 1 to 20, and more preferably 2 to 5 carbon atoms); $R_2$ has 1 to 40 carbon atoms (preferably 16 to 30, and more preferably 18 to 26 carbon atoms)

Specific examples of ester compounds represented by the foregoing formula are shown below but are by no means limited to these.

1) $CH_3\text{—}(CH_2)_{12}\text{—}COO\text{—}(CH_2)_{17}\text{—}CH_3$

2) $CH_3\text{—}(CH_2)_{18}\text{—}COO\text{—}(CH_2)_{17}\text{—}CH_3$

3) $CH_3\text{—}(CH_2)_{20}\text{—}COO\text{—}(CH_2)_{21}\text{—}CH_3$

4) $CH_3\text{—}(CH_2)_{14}\text{—}COO\text{—}(CH_2)_{19}\text{—}CH_3$

-continued

5) $CH_3\text{—}(CH_2)_{20}\text{—}COO\text{—}(CH_2)_6\text{—}O\text{—}CO\text{—}(CH_2)_{20}\text{—}CH_3$ 6)
$$CH_3\text{—}(CH_2)_{20}\text{—}COO\text{—}(CH_2)_2\text{—}\overset{\overset{CH_3}{|}}{CH}\text{—}CH_2\text{—}O\text{—}CO\text{—}(CH_2)_{20}\text{—}CH_3$$

7)
$$CH_3\text{—}(CH_2)_{22}\text{—}COO\text{—}(CH_2)_2\text{—}\overset{\overset{CH_3}{|}}{CH}\text{—}CH_2\text{—}O\text{—}CO\text{—}(CH_2)_{22}\text{—}CH_3$$

8)
$$CH_3\text{—}(CH_2)_{22}\text{—}COO\text{—}CH_2\text{—}\underset{\underset{CH_3}{|}}{\overset{\overset{CH_3}{|}}{C}}\text{—}CH_2\text{—}O\text{—}CO\text{—}(CH_2)_{22}\text{—}CH_3$$

9)
$$CH_3\text{—}(CH_2)_{26}\text{—}COO\text{—}CH_2\text{—}\underset{\underset{CH_3}{|}}{\overset{\overset{CH_3}{|}}{C}}\text{—}CH_2\text{—}O\text{—}CO\text{—}(CH_2)_{26}\text{—}CH_3$$

10)
$$\begin{array}{l} CH_2\text{—}O\text{—}CO\text{—}(CH_2)_{26}\text{—}CH_3 \\ | \\ CH\text{—}O\text{—}CO\text{—}(CH_2)_{26}\text{—}CH_3 \\ | \\ CH_2\text{—}O\text{—}CO\text{—}(CH_2)_{26}\text{—}CH_3 \end{array}$$

11)
$$\begin{array}{l} CH_2\text{—}O\text{—}CO\text{—}(CH_2)_{22}\text{—}CH_3 \\ | \\ CH\text{—}O\text{—}CO\text{—}(CH_2)_{22}\text{—}CH_3 \\ | \\ CH_2\text{—}O\text{—}CO\text{—}(CH_2)_{22}\text{—}CH_3 \end{array}$$

12)
$$\begin{array}{l} CH_2\text{—}OH \\ | \\ CH\text{—}O\text{—}CO\text{—}(CH_2)_{26}\text{—}CH_3 \\ | \\ CH_2\text{—}O\text{—}CO\text{—}(CH_2)_{26}\text{—}CH_3 \end{array}$$

13)
$$\begin{array}{l} CH_2\text{—}OH \\ | \\ CH\text{—}O\text{—}CO\text{—}(CH_2)_{22}\text{—}CH_3 \\ | \\ CH_2\text{—}O\text{—}CO\text{—}(CH_2)_{22}\text{—}CH_3 \end{array}$$

14)
$$\begin{array}{l} CH_2\text{—}OH \\ | \\ CH\text{—}OH \\ | \\ CH_2\text{—}O\text{—}CO\text{—}(CH_2)_{26}\text{—}CH_3 \end{array}$$

15)
$$\begin{array}{l} CH_2\text{—}OH \\ | \\ CH\text{—}OH \\ | \\ CH_2\text{—}O\text{—}CO\text{—}(CH_2)_{22}\text{—}CH_3 \end{array}$$

16)
$$CH_3\text{—}(CH_2)_{26}\text{—}COO\text{—}\underset{\underset{CH_2\text{—}O\text{—}CO\text{—}(CH_2)_{26}\text{—}CH_3}{|}}{\overset{\overset{CH_3}{|}}{C}}\text{—}CH_2\text{—}O\text{—}CO\text{—}(CH_2)_{26}\text{—}CH_3$$

17)
$$CH_3\text{—}(CH_2)_{20}\text{—}COO\text{—}CH_2\text{—}\underset{\underset{CH_2\text{—}O\text{—}CO\text{—}(CH_2)_{20}\text{—}CH_3}{|}}{\overset{\overset{CH_2CH_3}{|}}{C}}\text{—}CH_2\text{—}O\text{—}CO\text{—}(CH_2)_{20}\text{—}CH_3$$

-continued

18)

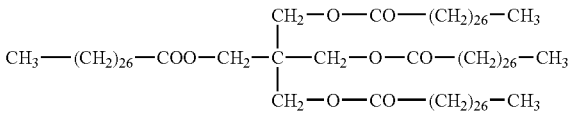

19)

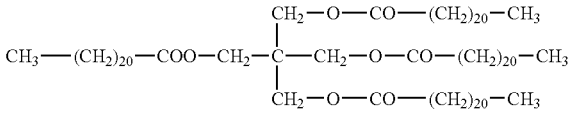

20)

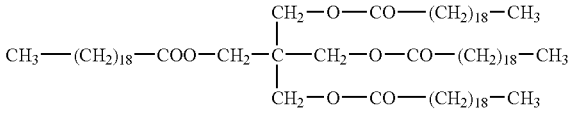

21)

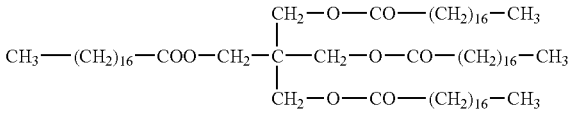

The foregoing mold-releasing agents, as a fixing modifier is added preferably in an amount of 1 to 30%, more preferably 2 to 20%, and still more preferably 3 to 15% by weight, based on the whole electrostatic image developing toner.

In the toner, it is preferred that the foregoing mold-releasing agent is allowed to be occluded in resin particles in the process of mini-emulsion polymerization and the resin particles, together with toner particles, are further allowed to be flocculate and fused.

Charge Control Agent:

In addition to the foregoing colorants and mold-releasing agents, there can be incorporated material giving various functions to the toner as a constituent. Specifically, examples thereof include a charge control agent. Such a constituent may be added concurrently with resin particles and color particles in the stage of flocculation/fusion, may be occluded in the toner, or may be incorporated to the resin particles.

As a charge control agent, commonly known, water-dispersible one is usable. Examples thereof include Nigrosine type dyes, metal salts of naphthenic acid or higher fatty acids, an alkoxylated amine, a quaternary ammonium salt compound, an azo type metal complex and a metal salicylate or its metal complex.

External Additive:

To improve flowability and enhance cleaning properties, so-called external additives may be incorporated. Such external additives are not specifically limited and include various inorganic particles, organic particles and lubricants.

Commonly known inorganic particulates are usable as an external additive used for the toner. Specifically, particulate silica, particulate titanium, and particulate aluminum are preferred. Hydrophobic inorganic particulates are preferred. Specific example of particulate silica include R-805, R-976, R-974, R-972, R-812 and R-809, which are commercial available from Nippon Aerogel Co., Ltd.; HVK-2150 and H-200, which are commercially available from Hoechst Co.; TS-72-, TS-530, TS-610, H-5 and MS-5, which are commercially available from Cabot Co., Ltd. Specific examples of particulate titanium include T-805 and T-604, which are commercial available from Nippon Aerogel Co., Ltd.; MT-100S, MT-100B, MT-500BS, MT-600 and MT-600SS, which are commercially available from TIKA Co., Ltd.; TA-300SI, TA-500, TAF-30, TAF-510 and TAF-510T, which are commercially available from Fuji Titan Co., Ltd.; IT-S, IT-OA, IT-OB and IT-OC, which are commercially available from Idemitsu Kosan Corp. Further, specific examples of particulate aluminum include RFY-C and C-604, which are commercial available from Nippon Aerogel Co., Ltd.; and TTO-55, available from ISHIHARA SANGYO KAISHA LTD.

Organic particulates usable as an external additive are spherical particulates having a number-average primary particulate size of 10 to 2000 nm. Examples of constituent material of such organic particulates include polystyrene, polymethylmethacrylate, and styrene-methyl methacrylate copolymer.

Lubricants usable as an external additive include higher fatty acid metal salts. Specific examples thereof include stearic acid metal salts such as zinc stearate, aluminum stearate, copper stearate, magnesium stearate, and calcium stearate; oleic acid metal salts such as zinc oleate, manganese oleate, iron oleate, copper oleate, and magnesium oleate; palmitic acid metal salts such as zinc palmitate, copper palmitate, magnesium palmitate, and calcium palmitate; linolic acid metal salts such as zinc linolate and calcium linolate; ricinolic acid metal salts such as zinc ricinolate and calcium ricinolate. The amount of an external additive to be added preferably is 0.1 to 5% by weight, based on toner.

Addition Step of External Additive:

The process of adding an external additive is the step of adding the external additive to dried toner particles. Well known various mixing apparatuses are usable as an apparatus to incorporate an external additive, including a turbulent mixer, a Henschel mixer, a nauter mixer and a V-type mixer.

Toner Particle:

The volume-average toner particle size is preferably 3 to 10 nm, and more preferably 3 to 8 nm. The particle size can be controlled by adjusting flocculent concentration, organic solvent amount, fusion time and polymer composition in the process of preparing the toner. Herein, the volume-average toner particle size refers to a median diameter D50 in the particle size distribution based on volume. A volume-average particle size of 3 to 10 μm reduces fine adhesive toner particles which are to be adhered to a heating member, causing off-setting and enhances transfer efficiency, leading to enhanced halftone image quality and enhanced fine-line and dot qualities.

The volume-average particle size of the toner can be measured using a laser diffraction type particle size measurement apparatus, Coulter Counter TA-11 (produced by Coulter Corp.). The particle size measurement was conducted using a Coulter multisizer which was connected to an interface outputting a particle size distribution and a personal computer. The foregoing Coulter Counter was used at an aperture of 100 μm and a volume distribution of toner particles of 2 μm or more (e.g., 2 to 40 μm) was measured to determine the particle size distribution and the average particle size.

Hereinafter, constitution of a developer using a toner and preparation thereof are described. The toner is usable as a single-component developer or a two-component developer. The single-component developers, usable as a nonmagnetic single-component developer or a magnetic single-component developer in which magnetic particles of 0.1 to 0.5 μm are contained in the toner.

A mixture of the toner with a carrier is usable as a two-component developer, in which commonly known materials including metals such as iron, ferrite or magnetite, or alloys of such metals and a metal such as aluminum or lead are usable as magnetic particles of the carrier. Specifically, ferrite is preferred. The magnetic particles preferably exhibit a volume-average particle size of 15 to 100 μm, and more preferably 25 to 80 μm. The volume-average particle size can be determined using, for example, a laser diffraction type particle size distribution measuring apparatus, provided with a wet disperser (HELOS, produced by SYMPATEC Corp.).

A carrier of resin-coated magnetic particles and a so-called resin dispersion type carrier of magnetic particles dispersed in resin are preferred. Resins used for coating are not specifically limited and, for example, olefin type resin, styrene type resin, styrene-acryl type resin, silicone type resin, ester type resin and fluorinated resin are usable. Resins used for the foregoing resin dispersion type carrier are not specifically limited, and include for example, styrene-acryl resin, polyester resin, fluorinated resin and phenol resin.

In an image forming apparatus as an example of this invention, a charging device, an exposure device, a development device and transfer device, and optionally a cleaning device are arranged near a photoreceptor. Of these, a charging device, a transfer device and a cleaning blade of a cleaning device which are directly in contact with a photoreceptor, are described below with respect to its constitution and preparation method.

(1) Charging Device:

A charging roller, a charging blade, a charging brush or a magnetic brush can be used as a charging device which charges in contact (pressure-contact) with a photoreceptor. Of these, a charging roller or a magnetic brush is preferably used. Thus, a charging roller or a magnetic brush is preferred in terms of uniformity in charging. The charging roller and magnetic brush are detailed below.

Charging Roller:

Charging by the use of a charging roller is conducted using either a direct current charging system applying a direct current (or DC) voltage to a roller or induction charging system applying an alternating current (or AC) voltage to a roller.

Any voltage frequency applied to the induction charging system is usable and to prevent strobing (lathe lines), an appropriate frequency can be chosen in accordance with the relative speed between a conductive elastic roller and the photoreceptor. The contact area of the conductive elastic roller and the photoreceptor determines the relative speed.

The conductive elastic roller is one in which a layer comprised of a conductive elastic material (also called simply conductive elastic layer or conductive rubber layer) covers the outer periphery of a mandrel. Examples of rubber composition used in the conductive rubber layer include polynorbornene rubber, ethylene-propylene rubber, chloroprene rubber, acrylonitrile rubber, silicone rubber and urethane rubber. These rubber can be used alone or in combinations thereof. To give electric conductivity, a conductivity-providing agent is incorporated to the rubber composition. Examples of an appropriate conductivity-providing agent include commonly known carbon black (furnace type carbon black or ketchen black) and powdery metals such as tin oxide. A conductive rubber composition is used in an amount of 5 to 50 parts based on the whole rubber composition.

In addition to a rubber substrate, a foaming agent and a conductivity-providing agent, rubber chemicals and rubber additives may be incorporated into the rubber composition to make a conductive foam rubber composition. Examples of rubber chemicals and rubber additives include a vulcanizing agent such as sulfur or a peroxide; vulcanization accelerators such as zinc white or stearic acid; a sulfenamide type, thiuram type, amine type, phenol type and phosphor type antioxidants; a UV absorber, an antidegradant for ozone, and an adhesion providing agent. Further, a reinforcing agent, friction factor-adjusting agent, and aninorganic filler such as silica, talc or clay are optionally used. The conductive rubber layer preferably exhibits a direct-current (or DC) volume resistivity of $10^3$ to $10^7$ Ω·cm.

To prevent adhesion of a residual toner or the like remaining on the photoreceptor surface to a charging member, a releasable covering layer may be provided on the outer surface of the conductive elastic layer, which prevents bleed-out of oil from the covering layer or the elastic layer and achieves functions such as canceling non-uniformity of resistance of the elastic layer to result in uniform resistance, protecting the charging roller surface and adjusting hardness of the charging roller. Any covering layer which satisfies the foregoing physical properties is acceptable, which may be comprised of a single layer or plural layers. Examples of material include hydrin rubber, urethane rubber, nylon, polyfluorovinylidene and polychlorovinilidene.

The covering layer thickness is preferably 100 to 1000 μm and the resistivity is preferably $10^5$ to $10^9$ Ω·cm. The resistivity preferably increases as the surface is approached. Examples of a method for adjusting resistivity include incorporation of conductive material such as carbon black, metal or metal oxide.

Incorporating particulate material to the surface layer (the conductive elastic layer or the covering layer) of the charging roller is preferred to adjust the surface roughness (Rz) of the charging roller. Usable particulate materials include inorganic and organic ones. The preferred inorganic material is silica powder. Organic ones include urethane resin particles, nylon particles, silicone rubber particles and epoxy resin particles. Of these, particulate urethane is preferred. The particles may be used singly or in combination of plural kinds thereof. Appropriate particles can be obtained by choosing material capable of adjusting the surface roughness of the surface layer to the range of 0.05 to 10.0 μm and the particle size ranging from 1 to 20 μm can achieve an intended surface roughness. The particulate material is incorporated into the surface layer, preferably in an amount of 5 to 20 parts by weight per 100 parts of resin.

The charging roller can be prepared, for example, in the following manner. Thus, into a molding die having a cylindrical molding space, a metallic rotating shaft (mandrel) is put into a molding die having a cylindrical molding space and the inside of the molding die is filled with conductive elastic layer-forming material, and is then subjected to vulcanization to form a conductive elastic layer on the outer peripheral surface of the rotating shaft. Subsequently, the rotating shaft forming the conductive elastic layer is taken out of the molding die. On the other hand, material such as urethane resin and additives such as particles, a conductivity-providing agent and the like are blended and the blended materials are mixed using a ball mill to prepare a surface layer forming material mixture. The thus prepared mixture is coated onto the surface of the conductive elastic layer formed on the rotation shaft so as to form a uniform thickness by a dip-coating method, a roll-coating method or a spray-coating method, and further subjected to thermally hardening to prepare a double-layered charging roller.

The outermost surface layer of the thus obtained charging roller exhibits an Rz value of 0.05 to 10.0 μm.

Magnetic Brush:

Next, there will be described magnetic particles forming a magnetic brush for charging.

In general, when magnetic particles forming a magnetic brush for charging exhibit a relatively large volume-average particle size, the state of the bits of the magnetic brush formed on a magnetic particle carrier become coarse, easily causing unevenness in the magnetic brush even when charged, while giving vibration by an electric field and producing a problem of uneven charging. To overcome this problem, magnetic particles having a relatively small volume-average size are preferred and as an experimental result, it was proved that a volume-average particle size of 200 μm or less began to exhibit effects and specifically, a volume-average particle size of 150 μm or less produced substantially no problem caused by coarseness of the magnetic brush bits. However, extremely fine particles easily adhere to the surface of a photoreceptor or easily scatter. These phenomena are related to the magnetic field strength applied to the particles and the resulting magnetization strength of the particles, and become marked when the volume-average particle size is 20 μm or less. In light of the foregoing, it is preferred that magnetic particles exhibit a volume-average size of 20 to 200 μm and that magnetic particles having particle sizes of not more than ½ times the number-average particle size account for not more than 30% by number of total magnetic particles. The magnetization strength preferably is $3.7\times10^{-2}$ to $13.0\times10^{-2}$ ewb·m/g.

The magnetic particles described above can be obtained in such a manner that ferromagnetic substances similar to magnetic carrier particles of a conventional two-component toner, including iron, chromium, nickel and cobalt metals or their compounds or alloys, such as ferrosoferric oxide, γ-ferric oxide, chromium dioxide, manganese oxide ferrite and manganese-copper alloy are usable as a magnetic material, and these magnetic particles or those obtained by coating the surface thereof with resin such as styrene type resin, vinyl type resin, ethylene type resin, rosin type resin, acryl type resin, polyamide resin, epoxy resin and polyester resin or those made of a resin containing the dispersed fine magnetic particles are subjected to particle size selection using a commonly known average particle size selection means.

FIG. 1 is a block diagram showing an example of a contact magnetic brush. As shown in FIG. 1, magnetic brush unit (120) as a charger faces rotating photoreceptor drum (3) and comprises cylindrical charging sleeve (120*a*) using aluminum or stainless steel material, as a carrier of magnetic particles for charging which is rotated in the same direction (counter-clockwise) at the close contact section with the receptor drum (3); magnet material (121) comprised of N and S poles, provided inside the charging sleeve (120*a*); a magnetic brush comprised of magnetic particles which are formed on the outer periphery of the charging sleeve (120*a*) by the magnet material (121) and used for charging the photoreceptor (3); scraper (123) to scrape the magnetic brush on the charging sleeve (20*a*) at the N-N-magnetic pole section of the magnet material (121); stirring screw (124) to stir magnetic particles inside the magnetic brush unit (120) or to allow used magnetic particles to overflow from outfall (125) of the magnetic brush unit (120) when supplying magnetic particles; and control plate (126) to control heading of magnetic brush bits. The charging sleeve (120*a*) which faces the photoreceptor (3) and is rotatable around the magnet material (121), is preferably rotated at a circumferential speed of 0.1 to 1.0 times that of the photoreceptor in the same direction as the moving direction of the photoreceptor. The charging sleeve (120*a*) uses a conductive transport carrier capable of applying a charging bias voltage and one having a structure in which the magnet material (121) having plural magnetic poles is provided inside the charging sleeve (120*a*) which forms a particle layer on the surface is specifically preferred. In such a transport carrier, the magnetic particle layer formed on the surface of the conductive charging sleeve (120*a*) moves in undulation by the relative rotation to the magnet material (121) and new magnetic particles are continuously supplied, so that even when the magnetic particle layer on the surface of the charging sleeve (120*a*) is more or less uneven in thickness, its influence is sufficiently covered with the undulation to an acceptable level. The surface of the charging sleeve (120*a*) preferably exhibits an average surface roughness of 5.0 to 30.0 μm to achieve stable, uniform transport of magnetic particles. The smoothed surface cannot achieve sufficient transport and the roughened surface allows excess current to flow from extrusions on the surface, and both cases trend to cause uneven charging. A sandblasting treatment is preferably used to realize the foregoing surface roughness. The outside diameter of the charging sleeve (120*a*) preferably is 5.0 to 20.0 mm and thereby, the contact region necessary for charging is secured. An overly large contact region causes an excessive charging current and an insufficient contact region trends to cause uneven charging. When the outside diameter is small, magnetic particles are easily scattered or adhered to the photoreceptor (3) due to centrifugal force so that the linear speed of the charging sleeve (120*a*) preferably is equivalent to or slower than the moving speed of the photoreceptor (3). In the FIG. 1, numerals 220 and 221 designate a toner hopper and a toner supplying screw, respectively; numeral 300 and designation "DB" represent a developer recovering box and a pipe transport section.

It is preferred that the magnetic particle layer formed on the charging sleeve (120*a*) has an adequate thickness so that the layer can be sufficiently scraped by a controlling means to form a uniform layer. In the charging region, an excessive amount of magnetic particles existing on the surface of the charging sleeve (120*a*) results in insufficient vibration of the magnetic particles, causing wear-out or uneven charging of the photoreceptor and producing defects such as an excessive current flow and the driving torque of the charging sleeve (120*a*) increases. On the contrary, an insufficient amount of magnetic particles existing in the charging region of the charging sleeve (120*a*) causes an incomplete contact with the photoreceptor drum (3), resulting in adherence of magnetic particles on the photoreceptor drum (3) or unevenness in charging.

Regarding the magnetic brush (120) as a charger, a charging bias in which alternating current (AC) bias AC3 is optionally overlapped with direct current (DC) bias E3, for example, a charging bias of a direct current bias E3 of −100 to −500 V, having the same polarity as the toner (at a minus polarity in this embodiment) and an alternating current bias AC3 of voltage 300 to 500 Vp-p at a frequency of 1 to 5 kHz, is applied to the charging sleeve (120*a*) and the circumferential surface of the photoreceptor drum (3) is contacted and rubbed, whereby the photoreceptor drum (3) is charged. Application of the alternating current bias AC3 forms an electric vibration field between the charging sleeve (120*a*) and the photoreceptor drum (3) and thereby, injection of an electric charge onto the photoreceptor via a magnetic brush is smoothly achieved, performing uniform charging at a high speed. In the FIG. 1, D/A, A/D and ES designate a D/A converter, A/D converter and surface potentiometer, respectively.

The magnetic brush on the charging sleeve (120*a*) which has charged the photoreceptor drum (3) is fallen, from the charging sleeve (120*a*), at the N-N magnetic pole section provided in the magnet material (121) by the scraper (123) and stirred near the charging sleeve (120*a*) by the stirring screw (124) rotating in the direction opposite to the charging sleeve (120*a*), then, a magnetic brush is formed again and transported to charging section (T).

(2) Transfer Device:

A transfer roller or transfer belt is usable as a transfer device, which is brought into contact (pressure-contact) with the photoreceptor surface. The transfer roller will be described below.

A transfer roller having an elastic rubber layer, as a transfer rotor is used, which is brought into contact (pressure-contact) with a photoreceptor or an intermediate transfer material to form a transfer nip and a toner on an image carrying material is transferred to a recording material, or to an intermediate transfer material, by the action of a transfer bias applied to the transfer roller.

An elastic roller exhibiting a hardness of 20 to 70 degrees (Asker hardness) is used as a transfer roller, which is generally comprised of a metal mandrel provided thereon with a conductive rubber elastomer layer exhibiting a resistivity adjusted to a resistivity of $1\times10^5$ to $1\times10^{10}$ Ω with carbon or an ionic conductive filler, or a foam rubber elastomer layer. Examples of composition usable in the rubber elastomer layer include polynorbornene rubber, ethylene-propylene rubber, chloroprene rubber, acrylonitrile rubber, silicone rubber and urethane rubber. These rubber materials may be used alone or in combinations.

(3) Cleaning Blade:

Cleaning means which contact a photoreceptor include a cleaning blade and cleaning brush, of which a cleaning blade is preferable. Hereinafter, cleaning of a cleaning blade is described.

A cleaning device (also called a cleaner) comprises a cleaning blade fixed onto a support member, in which the edge portion of the cleaning blade is in contact with the surface of the photoreceptor at a prescribed load. A rubber elastomer is used as the material for the cleaning blade, the composition thereof include, for example, urethane rubber, silicone rubber, fluorinated rubber, chloroprene rubber, and butadiene rubber. Of these, urethane rubber is specifically preferred in terms of superior abrasion resistance. For example, a urethane rubber obtained by curing a polycaprolactone ester with a polyisocyanate is preferred, as described in JP-A No. 59-30574. A urethane rubber exhibits a small content of impurities accelerating cracking and is effective especially when allowed to stand under high temperature and high humidity, as compared to other rubber materials.

Further, the support member is composed of plate metal material or plate plastic material. Examples of preferred metal plate material include stainless steel plate, aluminum plate and damping steel plate.

Figure 2:
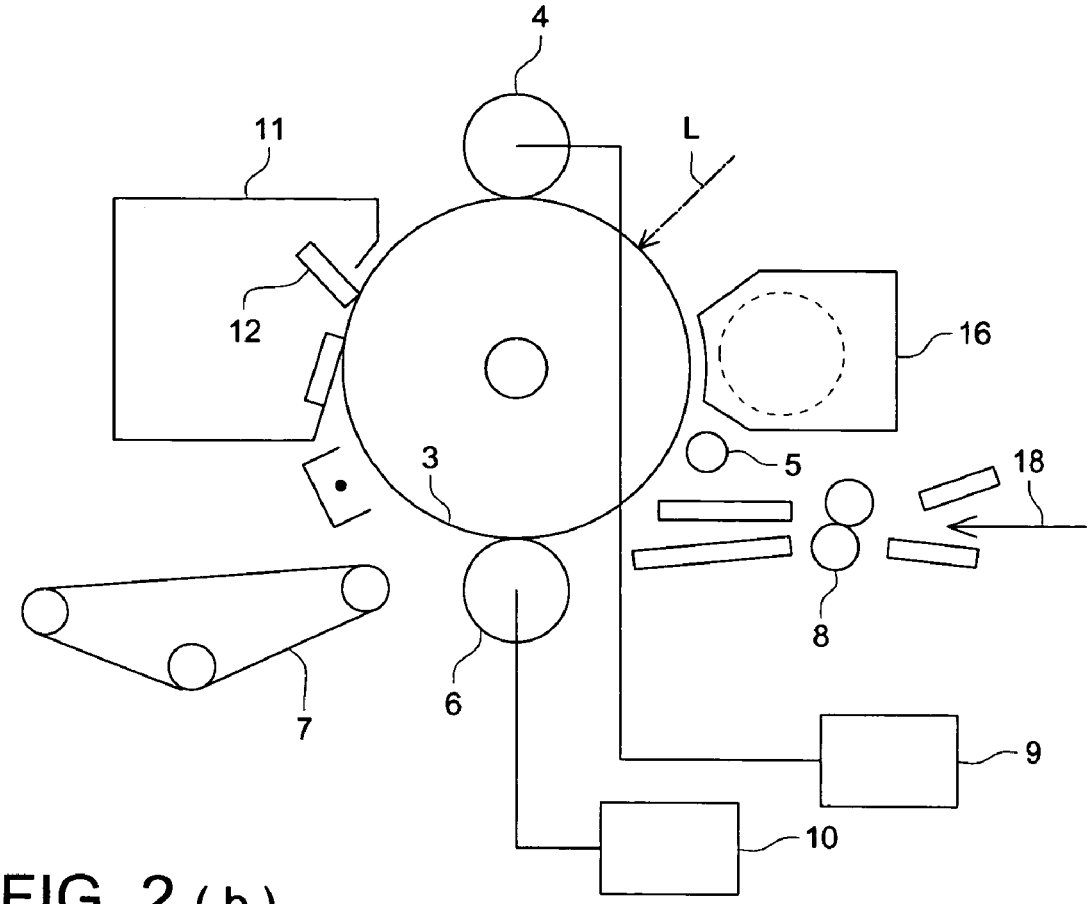
FIGS. 2(*a*) and 2(*b*) are a schematic diagrams illustrating an image forming apparatus applying a charging roller.
Figure 2:
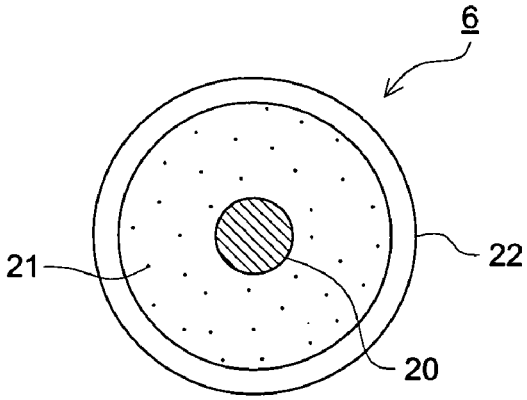

Next, an image forming apparatus, an image forming method and a process cartridge will be described but the present invention is by no means limited to these descriptions. FIGS. 2(*a*) and 2(*b*) are schematic views showing an exemplary image forming apparatus applying a charging roller. In the embodiment of this image forming apparatus, a charging roller is charged in contact with a photoreceptor drum to form an electrostatic latent image, a transfer roller is used in a transfer device to transfer a toner to transfer paper, and the transfer roller is brought into contact directly or via a transfer paper with the photoreceptor drum to avoid ozone generation.

In FIG. 2(*a*), an electrostatic latent image is formed on photoreceptor drum (3) which has been charged by charging roller (4). Then, the electrostatic latent image is developed to form a toner image by a developing sleeve as a developer carrier for developing device (16) arranged near the photoreceptor drum (3). Then, after the charge of the photoreceptor drum (3) is neutralized by a neutralization lamp (5) prior to transfer, the toner image is transferred to a transfer material (such as transfer paper, 18) which has been transported from a paper supply cassette by transport roller (8) and charged to a polarity opposite that of the toner by transfer roller (6), by the electrostatic force of the charge of the opposite polarity. After toner transfer, the transfer material (18) is separated from the photoreceptor (3) and transported to a fixing apparatus by a transport belt, and the toner image is fixed onto the transfer material (18) by a heating roller and a pressure roller.

To the charging roller (4) [and transfer roller (6)], a bias voltage comprised of DC and AC components is applied from power sources (9 and 10), and charging of the photoreceptor drum (3) and transferring the toner image to the transfer material (18) are performed, while minimizing generation of ozone. The bias voltage is comprised of a DC bias of ±500-1000 V which is overlapped with an AC bias of 100 Hz to 10 KHz and 200-350 Vp-p.

The charging roller (4) and the transfer roller (6) are driven or rotated while being in pressure-contact with the photoreceptor drum (3). The pressure contact to the photoreceptor drum is conducted at 0.1 to 1.0 N/cm and the roller is rotated at a speed of 1 to 8 times that of the circumferential speed of the photoreceptor drum (3).

As shown in FIG. 2(*b*), the charging roller (4) [and the transfer roller (6)] is comprised of mandrel (20) provided on the circumference thereof with rubber or sponge layer (21) of chloroprene rubber or urethane rubber, as a conductive elastic member, and preferably further thereon, protective layer (22) of a 0.01 to 1.00 μm thick releasable fluorinated resin or silicone resin layer, as an outermost layer.

After completion of transfer, the photoreceptor drum (3) is subjected to cleaning by contact with cleaning blade (12) of cleaning device (11) in preparation for the subsequent image formation.

In the image forming apparatus, a photoreceptor and any one of the following constituent elements such as a charging roller, a developing device, a transfer roller, and a cleaning device are integrated as a process cartridge and this integrated unit may be so arranged as to be detachable from the main body of the apparatus. Further, at least one of an image exposure device, a developing device, a transfer or separation device and a cleaning device is integrated with a photoreceptor to form a process cartridge and is made as a single unit detachable from the main body of the apparatus, which may be arranged so as to be loaded using a guide means such as a rail of the apparatus.

Figure 3:
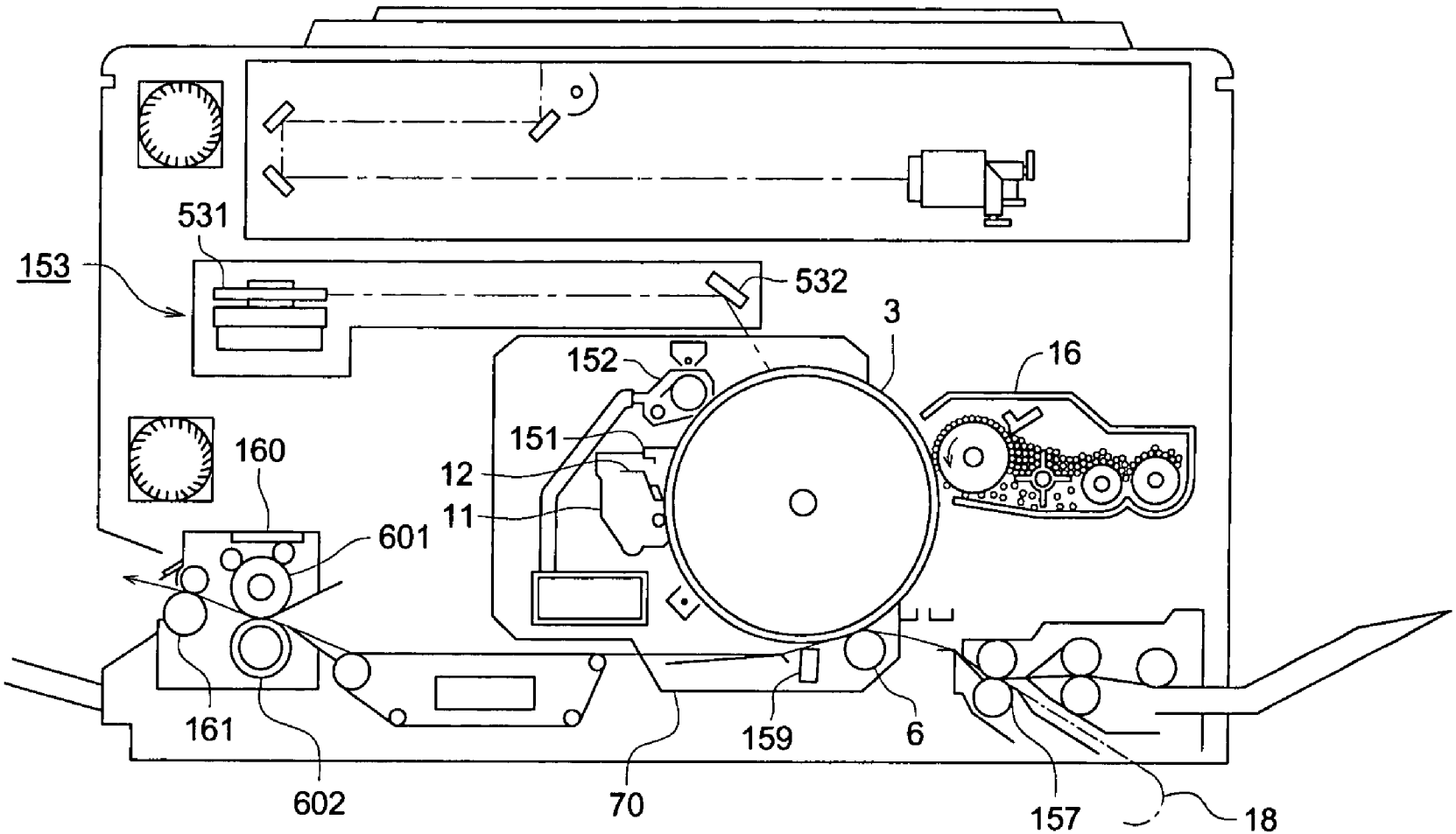
FIG. 3 is a schematic diagram illustrating an image forming apparatus applying a magnetic brush.

FIG. 3 is a section illustrating an image forming apparatus employing a magnetic brush. In FIG. 3, numeral "3" designates a photoreceptor drum (photoreceptor), which is grounded and is driven to rotate counter-clockwise. Numeral "152" designates a magnetic brush, which uniformly charges the circumference of photoreceptor drum (3). Prior to charging by the magnetic brush (152), exposure may be conducted in exposure section (151) using a light-emitting diode or the like to remove the history in the prior image formation.

After overall charging the photoreceptor, imagewise exposure is conducted based on image signals using image exposure device (153). Although not shown in FIG. 2, the image exposure device (153) uses a laser diode as a light source. Scanning onto the photoreceptor drum is conducted by a light which has been guided through rotating polygon mirror (531) and a "f" lens and the path of which has been bent by reflection mirror (532), to form an electrostatic latent image.

Subsequently, the electrostatic latent image is developed in developing device (16). Developing device (16) containing a developer comprised of a toner and a carrier is provided near the circumference of the photoreceptor drum (3), and development is undergone by a rotating developing sleeve having a built-in magnet and maintaining the developer. The developer is controlled so as to form a 100 to 600 μm thick layer on the developing sleeve by a layer forming means (not shown in FIG. 3) and transported to the development region to perform development. Usually, a DC bias voltage and optionally an AC bias are applied between the photoreceptor drum (3) and the developing sleeve to perform development. Ddevelopment is achieved, while the developer is in contact or non-contact with the photoreceptor.

The transfer material (18) is supplied to the transfer region by the rotation action of paper supply roller (6) at the time when transfer timing is adjusted after image formation. In the transfer region, synchronizing with transfer timing, the transfer roller (6) is brought into pressure-contact with the periphery of the photoreceptor drum (3) to perform transfer with nipping the supplied transfer material (18).

Subsequently, the transfer material (18) is neutralized by separation brush (159) which has been under pressure-contact during the same time as the transfer roller, is separated from the periphery of the photoreceptor drum (3) and transported to fixing device (160). After melting the toner by heating roller (601) and a pressure roller (602), the transfer material is discharged over discharging roller (161) outside of the apparatus. The transfer roller (6) and the separation brush (159) are separated from the periphery of the photoreceptor drum (3) after passage of the transfer material (18) to make preparation for the subsequent toner image formation.

On the other hand, after separating the transfer material (18), from the photoreceptor drum (3), removal and cleaning of any residual toner remaining is achieved by contact with the cleaning blade (12) of cleaning device (11) and the drum is again neutralized in exposure section (151) and charged by charging device (152), and initiating the subsequent image formation process. Further, numeral "70" designates a detachable process cartridge integrating a photoreceptor, a charging device, a transfer device, a separation device and a cleaning device.

In the embodiment of the image forming apparatus, as described above, constituent elements such as a photoreceptor, developing device and cleaning device may be integrated to form a process cartridge which is detachable from the main body of the apparatus. Further, at least one of a charging device, an image exposure device, a developing device, a transfer or separation device and a cleaning device may be integrated with a photoreceptor to form a process cartridge, which is arranged as a single unit, detachable from the main body of the apparatus, using a guide means such as rails within the main body of the apparatus.

The image forming apparatus referred to in this application is applicable to general electrophotographic apparatuses such as copiers, laser printers, LED printers and liquid crystal shutter type printers and is also widely usedo apparatuses of electrophotographic technique-applying display, recording, shortrun printing, printing plate making and facsimile applications.

EXAMPLES

The present invention will be further described based on examples but is by no mean limited to these examples.

Photoreceptor

Preparation of Photoreceptor 1

On a solid-drawn cylindrical aluminum substrate, the following interlayer coating solution was coated and dried to form a 0.5 μm thick interlayer.

| Interlayer Coating Solution | |
|---|---|
| Polyamide resin Amiran CM-8000 (produced by Toray) | 60 g |
| Methanol | 1600 ml |
| 1-Butanol | 400 ml |

Next, using a sand mill, the following composition was dispersed over a period of 10 hr. to prepare a coating solution for a charge generation layer, as described below. This coating solution was coated on the foregoing interlayer by a dip coating method to form a 2 μm thick charge generation layer.

| Coating Solution of Charge Generation Layer | |
|---|---|
| Y-type titanyl phthalocyanine | 60 g |
| Silicone resin solution (KR5240 15% xylene-butanol solution, produced by Shin-Etsu Chemical Co., Ltd.) | 700 g |
| 2-butanone | 2000 ml |

Finally, the following composition was mixed and dissolved to prepare a coating solution for a charge transport layer. This coating solution was coated on the foregoing charge generation layer by a dip coating method to form a 20 μm thick charge generation layer to prepare "Photoreceptor 1".

| | |
|---|---|
| Charge transporting compound [Compound (1-5)] | 200 g |
| Bisphenol Z-type polycarbonate (Yupilon Z300, produced by Mitsubishi Gas Kagaku) | 300 g |
| Tetrahydrofuran | 2000 ml |
| Toluene | 200 ml |

Preparation of Photoreceptor 2

Photoreceptor 2 was prepared similarly to the foregoing photoreceptor 1, except that compound (1-5) used as a charge transporting compound was replaced by compound (1-6).

Preparation of Photoreceptor 3

Photoreceptor 3 was prepared similarly to the foregoing photoreceptor 1, except that compound (1-5) used as a charge transporting compound was replaced by the following compound (2).

Compound (2)

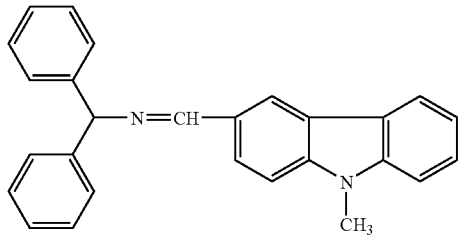

Preparation of Photoreceptor 4

Photoreceptor 4 was prepared similarly to the foregoing photoreceptor 1, except that compound (1-5) used as a charge transporting compound was replaced by the following compound (3).

Compound (3)

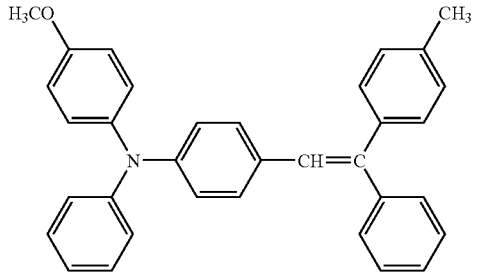

Preparation of Photoreceptor 5

Photoreceptor 4 was prepared similarly to the foregoing photoreceptor 1, except that compound (1-5) used as a charge transporting compound was replaced by the following compound (4).

Compound (4)

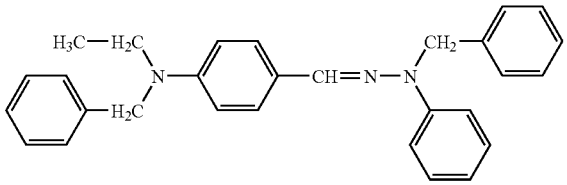

Toner

Preparation of Toner 1

Latex 1 containing 30% by weight of resin particles which was made of styrene, butylacrylate and 3-methcryloxy-2-hydroxypropyltimethylammonium chloride, in water containing 1.7% by weight of anonionic surfactant "ANTAROX" (trade name), 1.8% by weight of cationic surfactant SANIZOL B (trade name), dodecanethiol, carbon tetrachloride and a cationic initiator, 2,2-azobis(N,N'-dimethyleneisobutylamidine) dihydrochloride, was prepared in the following manner. To a 1 liter reaction vessel provided with a mechanical stirrer were added 328 g of styrene, 72 g of butylacrylate, 12 g of dodecanethiol, 4 g od carbon tetrachloride, 16 g of 3-methcryloxy-2-hydroxypropyltrimethylammonium chloride, 500 g of water. 8.6 g of ANTAROX (trade name), 9 g of SANOZOL B (trade name) and 13.5 g of 2,2-azobis(N,N'-dimethyleneisobutylamidine) dihydrochloride. The thus obtained mixture was heated at 70° C. for a period of 6 hr. under an atmosphere of nitrogen.

Color particle 1 which was comprised of 5% by weight of PV FASTBLUE (trade name) and 95% by weight of (styrene/butylacrylate/3-methacyloxy-2-hydroxypropyltrimethylammonium chloride), was prepared in the following manner. Thus, 300 g of the foregoing Latex 1 was added to a 1 liter reaction vessel provided with a mechanical stirrer. To this mixture, an aqueous 1% potassium hydroxide solution was dropwise added with stirring until reached a pH of ca. 10, while measuring the pH with litmus paper. The mixture was further stirred for 3 hr. To a 300 ml metal beaker, 15 g of PV FASTBLUE (trade name), 1.2 g of NEOGEN R (trade name, anionic surfactant) and 100 g of water were added and stirred using polytron at a rate of 8000 rpm to prepare pigment dispersion 1. The pigment dispersion 1 was added to a 1 liter flask containing the foregoing latex 1 and 100 of water was further added thereto. Flocculation of particles occurred and the mixture contained in the flask was homogenized, while stirring at 25° C. and 2000 rpm for 2 min. Subsequently, the mixture was heated to 60° C. in 1 hr. and then, an aqueous solution containing 25 water and 0.5 g of SANIZOL B (trade name) was added thereto. The mixture was heated to 96° C. in 2 hr. and after further heated for 3 hr., the mixture was cooled to room temperature at 25° C., filtered and sufficiently washed with water (ca. 16 liters). Then, the thus obtained reaction product was put into a drier at a reduced pressure of 1 kPa and dried at a temperature of 30° C. for 10 hr. to obtain color particle 1.

To 100 g of the thus prepared color particle 1, 8 g of hydrophobic silica particles exhibiting an average particle size of 0.05 μm was added as an external additive and treated using a mixer to obtain toner 1.

Preparation of Toner 2

To 40 g of the following compound (5) as a magenta pigment, 160 g of desalted water and 5 g of alkylbenzenesulfonate as a dispersant were added and dispersed using a sand grinder mill for 5 hr. to obtain a colorant dispersion exhibiting an average particle size of 0.18 μm.

Compound (5)

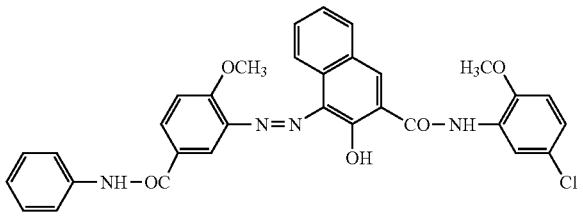

To a reaction vessel were added 2.2 kg of ester wax emulsion of 30% solid and 26 kg of desalted water, and after heated to 90° C., were further added 6 g of dodecylbenzenesulfonate, 5 kg of styrene, 1.3 kg of n-butylacrylate, 186 g of acrylic acid, 25 g of divinylbenzene (55% equivalent), 31 g of trichlorobromomethane, 656 g of an aqueous 8% hydrogen peroxide solution and 656 g of an aqueous 8% ascorbic acid solution. The reaction was continued at 90° C. for 7 hr. to obtain binding resin emulsion comprised of a styrene acryl polymer having a Mp of 52,800 and Mw of 112,400.

To 40 g of 4,4'-methylenebis{2-N-(4-chlorophenyl) amido}-3-hydroxynaphthalene}, 160 g of desalted water and 8 g of alkylnaphthalenesulfonates, as a dispersing agent were added and dispersed using a sand grinder mill for 3 hr. to obtain charge controlling agent dispersion 2.

To 300 g of the foregoing binding resin emulsion were added 19 g of the colorant dispersion 2 and 1.8 g of the charge controlling agent dispersion and mixed with stirring. To the mixture, 79 g of 0.5% $Al_2(SO_4)_3$ was added with stirring and heated to 60° C. and stirring was continued. Further thereto, 2 g of dodecylbenzenesulfonate was added, heated to 98° C. and stirring was allowed to continue for 7 hr. Obtained particles was repeatedly subjected to suction filtration and washing, then, put into a vacuum drier at a reduced pressure of 1 kPa and dried at 30° C. for 10 hr. to obtain 60 g of color particle 2. Thus obtained particles were measured with respect to particle size, using a Coulter counter and it was proved that the volume-average particle size was 7.6 μm.

To 100 go the thus obtained color particle 2, 1 g of silica which was subjected to a hydrophobic surface treatment, was added as an external additive and mixed with stirring to obtain toner 2.

Preparation of Toner 3

To 710 parts by weight of deionized water, 450 parts by weight of an aqueous 0.1 mol/l $Na_3PO_4$ solution was added and after heated to 60° C., the mixture was stirred using Clear Mixer (produced by M Technique Co., Ltd.) at 500 rpm. To the mixture, 68 parts by weight of an aqueous 1.0 mol/l $CaCl_2$ solution was added to obtain aqueous dispersion medium 3 in which $Ca_3(PO_4)_2$, as a dispersion stabilizer was finely dispersed.

First, of the formula described below, grafted carbon black, salicylic acid metal compound and 1-parts by weight of styrene monomer, as dispersoid, were dispersed over a period of 3 hr. to obtain colorant dispersion 3.

Next, all of the remainder of the formula were added, heated to 60° C. and dissolved with stirring for 30 min. In this solution was dissolved 10 parts by weight of 2,2'-azobis (2,4-dimethylvaleronitrile), as a polymerization initiator to obtain polymerizable monomer composition 3.

| | |
|---|---|
| Styrene monomer | 165 parts by weight |
| n-Butyl acrylate | 35 parts by weight |
| Grafted carbon black | 15 parts by weight |
| Saturated polyester | 15 parts by weight |
| Salicylic acid metal compound | 2 parts by weight |
| Compound (6) | 25 parts by weight |

(peaK temperature in DSC: 59.4° C.; Vickers hardness: 1.5)

Compound (6)

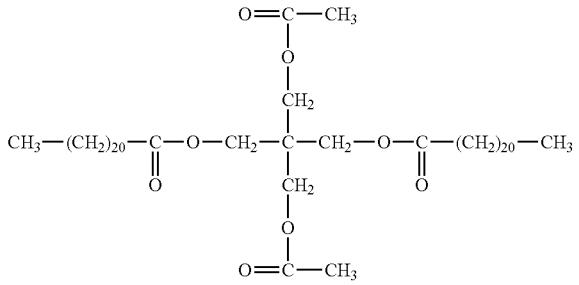

The polymerizable monomer composition 3 obtained above was added to the aqueous dispersion medium and granulated over a period of 15 min., while maintaining the rotation number. Thereafter, the high-speed stirrer was changed to a stirrer provided with a propeller blade, the internal temperature was raised to 80° C. and polymerization was allowed to continue for 10 hr. with stirring at 50 rpm. After completion of polymerization, slurry was cooled, diluted hydrochloric acid was added thereto and $Ca_3(PO_4)_2$, as a dispersion stabilizer, was dissolved therein, and then, filtration and washing carried out to obtain wet color particle 3 having a moisture content of 20%.

The thus obtained wet color particle 3 was pulverized and dried using flash dryer FJD-4 (produced by Seishin Kigyo Co., Ltd.). In the drying condition, 90° c. air was blown at a linear speed of 16.5 m/sec and the wet color particle 3 was continuously supplied at a rate of 20 kg/hr to undergo primary drying. After completion of the primary drying, the moisture content of the particles was 0.1%. At this stage, the content of the monomer remained in the particles was 680 ppm. The particles were put into a vacuum drier at a reduced pressure of 1 kPa and dried at 45° C. for 20 hr. to obtain 60 g of color particle 3.

To 30 kg of the color particle 3 was added titanium oxide having an average particle size of 0.05 μm, as an external additive and mixed with stirring to obtain toner 3.

Preparation of Toner 4

(1) Preparation of Nucleus Particle (1st Step Polymerization)

To a 5000 ml separable flask provided with a stirrer, a temperature sensor, condenser tube and nitrogen introducing device, a surfactant solution (aqueous medium) of 4.0 g of an anionic surfactant A ($C_{10}H_{21}(OCH_2CH_2)_2OSO_4Na$) dissolved in 3040 g deionized water were introduced and heated to 80° C. while stirring at a rate of 230 rpm in a stream of nitrogen. To the surfactant solution, a initiator solution of 10 g of a polymerization initiator (potassium persulfate: KPS) dissolved in 400 g deionized water was added and raised to a temperature of 75° C. and then, a monomer mixture solution comprised of 528 g of styrene, 204 g of n-butyl acrylate 68.0 g of methacrylic acid and n-octyl-3-mercaptopropionic acid ester was dropwise added over a period of 1 hr. The mixture was heated at 75° C. for 2 hr with stirring to undergo polymerization (1st step polymerization) to obtain a latex (dispersion of resin particles comprised of a high molecular weight resin). This was designated "latex (4H)".

(2) Formation of Interlayer (2nd Step Polymerization)

To a flask provided with a stirrer containing a monomer solution comprised of 95 g of styrene, 36 g of butyl acrylate, 9 g of methacrylic acid and 0.59 g of n-octyl 3-mercaptopropionate, 77 g of crystalline material, mold-releasing compound 19) exemplified earlier was added and dissolved with heating at 90° C. to obtain monomer solution 4.

Subsequently, 1.0 g of the foregoing anionic surfactant A was dissolved in 1560 ml of deionized water and heated at 98° C. To this surfactant solution, a nucleus particle solution of the foregoing latex (4H) was added in amount of 28 g solids (i.e., represented by equivalent converted to solids), further thereto, the monomer solution 4 obtained above was added and dispersed for 8 hr. using a mechanical stirrer having a circulating path (CLEARMIX, M Technique Co., Ltd.) to obtain a dispersion (emulsion) containing emulsion particles (oil droplets having a dispersion particle size of 284 nm).

Then, to the dispersion (emulsion), 5 g of polymerization initiator (KPS) dissolved in 200 ml deionized water and 750 ml of deionized water were added and heated at 98° C. for 12 hr. with stirring to perform polymerization (2nd polymerization) to obtain a latex (a dispersion of composite resin particles a structure in which the foregoing resin particles comprised of a high molecular weight resin were covered with an intermediate molecular weight resin). This was designated "latex (4HM)".

The latex (4HM) was dried and observed by a scanning electron microscope. As a result, there was observed particles (400 to 1000 nm) mainly composed of the exemplified compound (19) not surrounded by a latex.

(3) Formation of Outer Layer (3rd Step Polymerization)

To the latex (4HX) obtained was added an initiator solution of 6.8 g of polymerization initiator (KPS) dissolved in 265 ml deionized water. Further thereto, a monomer mixture solution comprised of 249 g of styrene, 88.2 g of n0butyl acrylate, 24.3 g of methacrylic acid and 7.45 g of n-octyl 3-mercaptopropionate was dropwise added over a period of 1 hr. After completing addition, the solution was heated for 1 hr. with stirring to perform polymerization (3rd polymerization) and cooled to 28° C. to a latex, dispersion of composite resin particles formed of a center portion comprised of a high molecular weight resin, an interlayer layer comprised of an intermediate molecular weight resin and an outer layer comprised of a low molecular weight resin, and the interlayer containing the exemplified compound (19). This was designated "latex 4HML".

Preparation of Latex (4L)

Into a flask provided with a stirring device, a solution of 14.8 g of a polymerization initiator (potassium persulfate: KPS) dissolved in 400 g deionized water was added and raised to a temperature of 80° C. and then, a monomer mixture solution comprised of 600 g of styrene, 190 g of n-butyl acrylate, 30 g of methacrylic acid and 20.8 g of n-octyl 3-mercaptoptopionate was dropwise added over a period of 1 hr. After completion of addition, the mixture was heated for 2 hr with stirring to undergo polymerization and the reaction mixture was cooled 28° C. to obtain a latex (dispersion comprised of low molecular weight resin particles). This was designated "latex (4L)".

The resin particles constituting the latex (4L) exhibited a molecular weight peak at 11,000 and a weight-average particle size of 128 μm.

Dispersion of Colorant

An anionic surfactant of 90.0 g was dissolved in 1600 ml deionized water. To this solution, 400.0 g of carbon black (Regal 330R, product of Cabot Co.) was gradually added with stirring and then dispersed using a mechanical stirrer (CLEAR MIX, M Technique Co., Ltd.) to obtain a dispersion of color particles (hereinafter, denoted as colorant dispersion 4). The color particle size (weight-average particle size) of this dispersion, which was measured using an electrophoresis light scattering photometer (ELS-800, product of Ohtsuka Denshi Co.), was 110 nm.

Preparation of Color Particle 4

Flocculation and fusion of composite resin particles and color particles were carried out according to the following procedure. To a reaction vessel (four-bottled flask) provided with a temperature sensor, condenser, nitrogen introducing device and stirrer were added with stirring latex (4L) of 420.7 g (solids content), 900 g of deionized water and 200 g of the obtained colorant dispersion 4. After the internal temperature of the vessel was adjusted to 30° C., an aqueous solution of sodium hydroxide was added to the solution to adjust the pH to 9.0.

Subsequently, 12.1 g of magnesium chloride hexahydrate dissolved in 1000 ml deionized water was added with stirring at 30° C. over a period of 10 min. After being allowed to stand for 3 min., heating was started and the temperature was raised to 90° C. over a period of 60 min. While maintaining this state, the size of fused particles were measured using Coulter counter TA-II and when reached a volume-average particle of 5.0 μm, 40.2 g of sodium chloride dissolved in 1000 ml deionized water was added to stop the growth of the particles. Further, the reaction mixture was ripened at 98° C. for 6 hr. to continue flocculation and fusion, and thereafter cooled to 30° C. at a rate of 8° C./min.

Shelling the particles obtained above was conducted in the following manner. After completion of the foregoing flocculation and fusion of the particles, 96 g of latex (4L) was added thereto and stirred for 3 hr. with heating to allow the latex (4L) to be shelled onto the surface of fused particles of the latex (4L). Further, 40.2 g of sodium chloride was added and the reaction mixture was cooled to 30° C. at a rate of 8° C./min, the pH was adjusted to 2.0 with hydrochloric acid and stirring was stopped. Particles which were thus formed by the foregoing procedure, were repeatedly filtered and washed with 45° C. deionized water. Thereafter, the particles was put into a vacuum dryer at a reduced pressure of 1 kPa and dried at 40° C. for 20 hr. to obtain color particles (denoted as color particle 4).

To the color particle 4, 1% by weight of hydrophobic silica (number-average primary particle size of 12 nm, a hydrophobicity degree of 68) and 1.25 by weight of hydrophobic titanium (number-average primary particle size of 20 nm, a hydrophobicity degree of 63) were added and treated with a Henschel mixer to obtain toner 4.

Preparation of Toner 5

Toner 5 was prepared similarly to foregoing tone 1, except that the drying condition (drying at 30° C. for 10 hr in a vacuum dryer at a reduced pressure of 1 kPa) was changed to that of drying at 30° C. for 10 hr. in a dryer at ordinary pressure.

Preparation of Toner 6

Toner 6 was prepared similarly to foregoing tone 3, except that the drying condition (drying at 45° c. for 20 hr in a vacuum dryer at a reduced pressure of 1 kPa) was changed to that of drying at 30° C. for 5 hr. in a dryer at ordinary pressure.

Preparation of Toner 7

Toner 7 was prepared similarly to foregoing tone 4, except that the drying condition (drying at 40° C. for 20 hr in a vacuum dryer at a reduced pressure of 1 kPa) was changed to that of drying at 45° C. for 60 hr. in a vacuum dryer at a reduced pressure of 1 kPa.

Preparation of Toner 8

Toner 8 was prepared similarly to foregoing tone 2, except that the drying condition (drying at 30° c. for 10 hr in a vacuum dryer at a reduced pressure of 1 kPa) was changed to that of drying at 30° C. for 5 hr. in a vacuum dryer at a reduced pressure of 1 kPa.

Determination of Aromatic volatile Compound

The content of aromatic volatile compounds in the respective toners 1 to 8 was determined in the head space gas chromatography described earlier.

It is proved that contents of aromatic volatile compound toners 1 to 4 each fell within the range (5 to 30 ppm) relating to this invention, but those of toners 5 to 8 fell outside the range relating to this invention.

Drying conditions and contents of aromatic volatile compounds for the respective toners are shown in Table 1.

TABLE 1

| Toner No. | Drying Condition Pressure | Temperature (° C.) | Time (hr) | Content of Aromatic volatile Compound (ppm) |
|---|---|---|---|---|
| 1 | red.* | 30 | 10 | 20 |
| 2 | red.* | 30 | 10 | 30 |
| 3 | red.* | 45 | 20 | 5 |
| 4 | red.* | 40 | 20 | 10 |
| 5 | ord.** | 30 | 10 | 65 |
| 6 | ord.** | 30 | 5 | 110 |
| 7 | red.* | 45 | 60 | 3 |
| 8 | red.* | 30 | 5 | 45 |

*reduced pressure
**ordinary pressure

Preparation of Developer

Each of the foregoing toners 1 to 8 was mixed with ferrite carrier particles coated with silicone resin, having a volume-average particle size of 60 μm to prepare a developer so that the toner concentration was 6%. The thus prepared developers designated developer 1 to 8.

Evaluation Machine

To evaluate image formation were employed modified copier 1 of Konica 7065 (produced by Konica Corp.) in which a cleaning blade composed of a urethane member was used, a corona charger was changed to a charging roller composed of a urethane member, a corona transfer device was changed to a transfer roller composed of a urethane member and a potentiometer was installed to measure the surface potential; modified copier 2 of Konica 7065 (produced by Konica Corp.) in which a cleaning blade composed of a urethane member, a corona charger was changed to a magnetic brush, a corona transfer device was changed to a transfer roller composed of a urethane member, a cleaning blade was removed and a potentiometer was installed to measure the surface potential.

In Table 2 were shown photoreceptor No., toner No., developer No., evaluation machine, the load of a cleaning blade and the setting temperature of a fixing roller.

TABLE 2

| Evaluation No. | Receptor No. | Toner No. | Developer No. | Evaluation Machine | Load of Cleaning Blade (g/cm) | Setting Temperature of Fixing Roller (° C.) |
|---|---|---|---|---|---|---|
| 1 | 1 | 1 | 1 | 1* | 25 | 145 |
| 2 | 2 | 2 | 2 | 1* | 40 | 175 |
| 3 | 3 | 3 | 3 | 2** | — | 135 |
| 4 | 1 | 4 | 4 | 2** | — | 160 |
| 5 | 1 | 4 | 4 | 2** | — | 160 |
| 6 | 4 | 5 | 5 | 1* | 40 | 145 |
| 7 | 5 | 6 | 6 | 2** | — | 135 |
| 8 | 5 | 7 | 7 | 2** | — | 160 |
| 9 | 1 | 8 | 8 | 1* | 40 | 175 |

*modified machine 1
**modified machine 2

Evaluation

Using the foregoing modified copiers 1 and 2, the unexposed area potential (VH) and the exposed area potential (VL) were measured by a potentiometer installed in each of the modified copiers, and the print image density was also measured. Thereafter, using transfer paper of 64 g/m$^2$, printing of 10,000 sheets was conducted under an environment of high temperature and high humidity (30° C., 80% RH). After completion of printing of 10,000 sheets, the unexposed area potential (VH), the exposed area potential (VL) and print image density were each measured.

Further, after allowing the modified copiers 1 and 2 which completed printing of 10,000 sheets to stand for 1 week under an environment of high temperature and high humidity (30° C., 80% RH), the unexposed area potential. (VH) and the exposed area potential (VL) were measured and the surface state of the respective photoreceptors was visually observed. Thereafter, printing was conducted and image quality of obtained prints was visually evaluated for each of the copiers. The image density was measured using Macbeth reflection densitometer RD-918 (produced by Macbeth Corp.).

Evaluation results are shown in Table 3. The image density was evaluated based on the following criteria:

| Image Density | Evaluation |
|---|---|
| 1.40 or more | excellent and no problem in practice |
| 1.30-1.39 | superior and no problem in practice |
| 1.20-1.29 | slightly low density but no problem in practice |
| 1.19 or less | low density and problem in practice |

TABLE 3

| Evaluation No. | Surface Potential of Photoreceptor: Start VH (V) | Start VL (V) | After 1 week VH (V) | After 1 week VL (V) | After 1 week: Surface State of Photoreceptor | After 1 week: Print Image Quality | Image density: Start | Image density: 10,000 sheet print | Remark |
|---|---|---|---|---|---|---|---|---|---|
| 1 | 750 | 85 | 755 | 90 | no change | Superior | 1.40 | 1.40 | Inv. |
| 2 | 755 | 95 | 750 | 105 partially 115) | no change | Superior | 1.42 | 1.42 | Inv. |
| 3 | 745 | 85 | 755 | 90 | no change | partially letter missing | 1.35 | 1.09 | Comp. |
| 4 | 750 | 90 | 755 | 90 | no change | Superior | 1.40 | 1.40 | Inv. |
| 5 | 750 | 90 | 755 | 90 | no change | Superior | 1.42 | 1.42 | Inv. |
| 6 | 750 | 85 | 755 | 105 (partially 150) | cracking | * | 1.42 | 1.40 | Comp. |
| 7 | 750 | 85 | 755 | 115 (partially 145) | cracking | * | 1.40 | 1.38 | Comp. |
| 8 | 750 | 85 | 755 | 125 (partially 185) | cracking | * | 1.41 | 1.34 | Comp. |
| 9 | 750 | 95 | 750 | 105 (partially 155) | cracking | * | 1.41 | 1.37 | Comp. |

*: A partial increase of density was observed in the halftone portion.

As apparent from Table 3, it was proved that in evaluation Nos. 1, 2, 4 and 5 in which a photoreceptor using a charge transport compound having a triphenylamine structure, represented by formula (1) and a toner having an aromatic volatile compound content of 5 to 30 ppm, no change in surface potential or surface state of a photoreceptor was observed even after allowed to stand in an environment of high temperature and high humidity, and superior print quality and enhanced image density were achieved.

It was further proved that superior results were achieved, as compared to evaluation Nos. 3 and 6 to 9 in which a photoreceptor not using a charge transport compound having a triphenylamine structure, represented by formula (1) and a toner having an aromatic volatile compound content of less than 5 ppm or more than 30 ppm.

Thus, as demonstrated in the foregoing examples, even when printing was conducted over a long period of time under an environment of high temperature and high humidity, no deterioration in the photosensitive layer of a photoreceptor occurred and high quality images were stably obtained.

What is claimed is:

1. An image forming method comprising:

forming an electrostatic latent image on an electrophotographic photoreceptor, and developing the electrostatic latent image with a developer containing a toner to form a toner image, wherein the photoreceptor contains a charge transport compound having a triphenylamine structure, and the toner having a total content of aromatic volatile compounds of 5 to 30 ppm.

2. The method of claim 1, wherein the method further comprises the step of:

transferring the toner image onto a transfer material.

3. The method of claim 2, wherein the method further comprises the step of:

fixing the toner image transferred onto the transfer material at a temperature of 135 to 160° C.

4. The method of claim 2, wherein the method further comprises the step of:

charging the photoreceptor.

5. The method of claim 4, wherein said charging the photoreceptor or transferring the toner image is performed while being brought into contact with the photoreceptor.

6. The method of claim 5, wherein charging is performed while a magnetic brush or a roller is brought into contact with the photoreceptor.

7. The method of claim 1, wherein the total content of aromatic volatile compounds is 8 to 25 ppm.

8. The method of claim 1, wherein the triphenylamine structure is represented by the following formula:

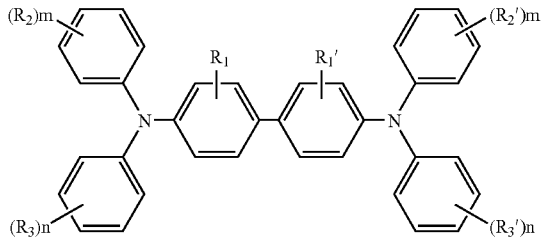

wherein $R_1$ and $R_1'$ are each a halogen atom, an alkyl group, or an alkoxy group; $R_2$, $R_2'$, $R_3$ and $R_3'$ are each a halogen atom, an alkyl group, an allyl group, an alkenyl group, an alkoxy group or an amino group; m and n are each 0, 1 or 2.

9. The method of claim 8, wherein the total content of aromatic volatile compounds is 8 to 25 ppm.

10. The method of claim 1, wherein the photoreceptor comprises a layer containing a binder and the layer further contains the compound having a triphenylamine structure in an amount of 10 to 500 parts, based on 100 parts of the binder.

11. The method of claim 1, wherein the toner contains a compound represented by the following formula:

$$R_1—(OCO—R_2)_n$$

wherein $R_1$ and $R_2$ are each a hydrocarbon group; and n is an integer of 1 to 4.

* * * * *